US012612835B2

(12) United States Patent
Church et al.

(10) Patent No.: US 12,612,835 B2
(45) Date of Patent: Apr. 28, 2026

(54) SIDEWALL DRILLING TOOL WITH HYDRAULICALLY OPERATED ANCHORING MEMBER AND DRILLING MEMBER

(71) Applicant: Kaseum Holdings Limited, Aberdeen (GB)

(72) Inventors: Paul Andrew Church, Danestone (GB); Peter Alan Joiner, Danestone (GB); Andrew John Elrick, Peterhead (GB); Stewart Gordon George Christie, Dyce (GB); Jason Duthie, Aberdeen (GB); Iain Morrison Macleod, Newmachar (GB)

(73) Assignee: KASEUM HOLDING LIMITED, Aberdeen (GB)

( * ) Notice: Subject to any disclaimer, the term of this patent is extended or adjusted under 35 U.S.C. 154(b) by 0 days.

(21) Appl. No.: 19/115,037

(22) PCT Filed: Oct. 18, 2023

(86) PCT No.: PCT/GB2023/052704
§ 371 (c)(1),
(2) Date: Mar. 25, 2025

(87) PCT Pub. No.: WO2024/084208
PCT Pub. Date: Apr. 25, 2024

(65) Prior Publication Data

US 2025/0369298 A1 Dec. 4, 2025

(30) Foreign Application Priority Data

Oct. 21, 2022 (GB) ..... 2215656

(51) Int. Cl.
*E21B 29/00* (2006.01)
*E21B 23/04* (2006.01)

(52) U.S. Cl.
CPC ..... *E21B 29/005* (2013.01); *E21B 23/04* (2013.01)

(58) Field of Classification Search
CPC ..... E21B 29/005; E21B 23/04
See application file for complete search history.

(56) References Cited

U.S. PATENT DOCUMENTS 3,305,018 A * 2/1967 White, Jr. ..... E21B 43/117 166/100
5,183,111 A 2/1993 Schellstede
(Continued)

FOREIGN PATENT DOCUMENTS

NO 20150623 A1 11/2016

OTHER PUBLICATIONS

European Patent Office acting as the International Searching Authority; International Search Report and Written Opinion regarding PCT/GB2023/052704, mail date Jan. 17, 2024.
(Continued)

*Primary Examiner* — Steven A Macdonald
(74) *Attorney, Agent, or Firm* — DUNLAP CODDING, P.C.

(57) ABSTRACT

A downhole drilling tool for forming a port through a tubular sidewall. The tool comprises a body with a longitudinal axis, at least one anchoring member and a drilling member. Both members are radially movable between retracted and extended positions by pressurised hydraulic fluid from a common downhole supply. The anchoring member stabilises the tool against the tubular wall, and the drilling member, arranged substantially perpendicular to the tool axis, is rotatable to cut through the sidewall. Fluid communication between the members ensures they experience the same hydraulic pressure. The tool may be powered by a battery-driven motive assembly that also pressurises the hydraulic
(Continued)

fluid and provides torque for rotation. A method of drilling through a tubular sidewall using the tool.

30 Claims, 13 Drawing Sheets

(56) References Cited

U.S. PATENT DOCUMENTS

| | | | | |
|---|---|---|---|---|
| 5,622,231 | A | 4/1997 | Thompson | |
| 6,167,968 | B1 | 1/2001 | Allarie et al. | |
| 7,673,704 | B2 | 3/2010 | Phan et al. | |
| 8,813,844 | B2 | 8/2014 | Hopkins et al. | |
| 9,217,328 | B2 * | 12/2015 | Yang | E21B 44/04 |
| 10,988,991 | B1 * | 4/2021 | McCormick | E21B 17/1021 |
| 11,859,472 | B2 * | 1/2024 | Al Sulaiman | E21B 33/12 |
| 11,982,152 | B2 * | 5/2024 | Krüger | E21B 33/13 |
| 12,410,691 | B2 * | 9/2025 | Al Sulaiman | E21B 33/12 |
| 2002/0011358 | A1 * | 1/2002 | Wassell | E21B 7/06 175/73 |
| 2006/0032672 | A1 * | 2/2006 | Latos | E21B 17/20 175/82 |
| 2006/0254763 | A1 * | 11/2006 | Tips | E21B 34/16 166/65.1 |
| 2011/0278070 | A1 | 11/2011 | Hopkins et al. | |
| 2012/0318579 | A1 * | 12/2012 | Yang | E21B 44/005 175/44 |
| 2014/0124191 | A1 * | 5/2014 | Hallundbæk | E21B 29/005 166/55.2 |
| 2014/0360784 | A1 * | 12/2014 | Hunziker | E21B 10/02 175/58 |
| 2016/0024899 | A1 * | 1/2016 | Lynn | E21B 43/26 166/305.1 |
| 2016/0258257 | A1 * | 9/2016 | Babin | E21B 29/005 |
| 2017/0234115 | A1 | 8/2017 | Sandkleiva | |
| 2019/0353009 | A1 * | 11/2019 | Nanayakkara | H02K 7/1807 |
| 2020/0325746 | A1 * | 10/2020 | Lerbrekk | E21B 33/13 |
| 2020/0332615 | A1 * | 10/2020 | Wiesenborn | E21B 41/0085 |
| 2021/0387269 | A1 * | 12/2021 | McAllister | E21B 23/01 |
| 2022/0298897 | A1 * | 9/2022 | Al Sulaiman | E21B 29/06 |
| 2024/0084679 | A1 * | 3/2024 | Al Sulaiman | E21B 33/12 |

OTHER PUBLICATIONS

United Kingdom Intellectual Property Office; Combined Search and Examination Report regarding patent application No. GB2315950.2, dated Mar. 25, 2024.

United Kingdom Intellectual Property Office; Search Report regarding patent application No. GB2215656.6; dated Jul. 31, 2023.

* cited by examiner

SECTION A-A

SECTION B-B

SECTION D-D

SECTION E-E

SECTION F-F

SECTION L-L

SIDEWALL DRILLING TOOL WITH HYDRAULICALLY OPERATED ANCHORING MEMBER AND DRILLING MEMBER

The present application relates, generally, to an apparatus and method relating to a tubular sidewall drilling tool and a method of drilling through the sidewall of a tubular or formation in a downhole environment.

BACKGROUND OF THE INVENTION

During downhole recovery operations it can be necessary to drill through the sidewall of tubular members such as production tubing, casing, lining, drill pipe, mandrels and other tubing and occasionally it may be required to drill a relatively small aperture in another downhole structure including the formation.

Conventional sidewall drilling tools comprise drilling tools, milling tools, or lathe-like cutters, which are run downhole on e-line. These tools require high levels of DC power to be supplied in order to provide the rotational power coupled with the applied force needed to drill through the sidewall of a downhole tubular member. The use of e-line provides the tool with effectively unlimited power during drilling operations to drill through the target. However, e-line operations require personnel to have higher levels of training to operate tools powered this way due to, for example, increased risks associated with the high voltages supplied.

Such conventional drilling tools can take some time to drill through the sidewall of the tubular member, with higher heat generation and increased power demands the longer a drilling operation goes on.

Additionally, conventional sidewall drilling tools must be sent downhole with pre-determined settings and may require several trips to the target location to complete the drilling operation if a change in operation parameters is required (for example setting incremental increases to the maximum radial extension of the drilling device to allow it to drill further into the tubular wall).

An example of such a conventional e-line run drilling tool is that shown in EP3008277 to Welltec A/S which has a first tool part which includes an anchoring section 6 for anchoring the tool in a predetermined position in the casing and a second tool part which comprises a machining bit being moveable in a radial direction, where a number of different motors are provided to operate the e-line run drilling tool.

NO20150623 to Sintef TTO AS discloses a milling tool with self driven active side cutters which utilises an actuator to extend (into a milling position) and retract a rotational side cutter and a separate actuator to extend and retract anchor elements, where the actuating mechanisms can comprise one of drilling mud pressure or mechanical means.

U.S. Pat. No. 5,622,231 to Thompson discloses an extendable drill bit provided within a cylindrical vessel where the drill bit can be further extended laterally outwards by means of a supply of modular drill string elements which are cyclically inserted between a hydraulic fluid operated insert ram and the drill bit so that repeated extensions of the insert ram further extends the drill bit into the surrounding medium to increase the length of the lateral borehole. An upper and a lower pair of anchor shoes to can be extend outwards and retract inwards by operation of respective hydraulic cylinders. The insert ram and the said respective hydraulic cylinders are supplied with hydraulic fluid from a single reservoir located within the cylindrical vessel but via respective hydraulic pumps such that the pressure experienced by the insert ram compared with the said respective hydraulic cylinders will be different due to the separation therebetween, and where the said respective hydraulic pumps are powered by a turbine which in turn is powered by high pressure mud pumped from the surface of the well.

U.S. Pat. No. 8,813,844 to Schlumberger discloses a drilling system for drilling a lateral borehole from a main borehole and comprises a tubular conduit through which a fluid such as drilling fluid can be pumped, and a drilling assembly connected to the tubular conduit so as to receive the drilling fluid pumped therethrough. The drilling assembly comprises a power conversion unit, through which the drilling fluid flows and which operates to provide a downhole power output; a drilling unit including a drilling apparatus powered by the output of the power conversion unit and operable to drill a lateral borehole into the formation surrounding the main borehole, and a liner unit for storing one or more liners for installation into the lateral borehole; and an anchor unit operable to anchor the drilling assembly in the main borehole when the drilling unit operates to drill the lateral borehole.

Due to the limitations with conventional drilling tools it would be beneficial to provide a drilling tool with an alternative power supply (and particularly its own on board power supply e.g. battery powered) that does not need to be run in on e-line and therefore does not have the additional onerous safety and training requirements. This would allow a far greater number of operators to use such a tool.

It would also be beneficial to provide as compact a drilling tool (in terms of its longitudinal length) as possible. More compact tools are desired by operators as they typically reduce the cost and time involved in the running in/pulling out of the wellbore.

Additionally, further improvements in terms of the performance of conventional drilling tools and also in terms of reducing the costs of such conventional drilling tools, would be highly desirable, particularly given the need in the oil and gas industry as well as the geothermal industry to reduce costs wherever possible.

SUMMARY OF THE INVENTION

A drilling tool for use in a well, the drilling tool being adapted to connect to a downhole hydraulic fluid supply, the drilling tool having a longitudinal axis; the drilling tool comprising:

- at least one anchoring member having an inner face contactable by hydraulic fluid from said downhole hydraulic fluid supply and being moveable radially, by means of pressurised hydraulic fluid from said downhole hydraulic fluid supply acting upon said inner face, with respect to the longitudinal axis of the drilling tool, between:—
- a retracted position in which the at least one anchoring member is spaced apart from an inner surface of the well; and
- an extended position in which the anchoring member contacts an inner surface of the well; and
- a drilling member having a longitudinal axis and having an inner face contactable by hydraulic fluid from said downhole hydraulic fluid supply, the drilling member being rotatable in use about said longitudinal axis, wherein the drilling member is arranged within the drilling tool such that the longitudinal axis of said drilling member is substantially perpendicular to said longitudinal axis of said drilling tool, and wherein the drilling member is also moveable radially by means of pressurised hydraulic fluid from said downhole hydraulic fluid supply acting upon said inner face thereof; and wherein said drilling member is moveable radially, by means of pressurised downhole hydraulic fluid from said downhole hydraulic fluid supply acting upon said inner face, with respect to the longitudinal axis of the drilling tool between:— a retracted position in which the drilling member is spaced apart from an inner surface of the well; and an extended position in which the drilling member contacts an inner surface of the well; and wherein the inner face of the anchoring member is in fluid communication via said hydraulic fluid with the inner face of the drilling member such that both respective inner faces experience the same pressure of the said hydraulic fluid acting upon them.

Preferably, the drilling tool is further adapted to also connect to a downhole torque generator (as well as the said downhole hydraulic fluid supply). Preferably, the drilling tool is a downhole tubular drilling tool for drilling a port through a sidewall of a downhole tubular.

Embodiments of the present invention have the advantage that both the at least one anchoring member and the drilling member are capable of being moved radially by means of the same downhole hydraulic fluid supply which results in a more efficient and more compact drilling tool.

The supply or source of pressurised downhole hydraulic fluid could be any suitable supply or source of pressurised downhole hydraulic fluid. The provision of the pressurised downhole hydraulic fluid provides the advantage that the pressurised hydraulic fluid does not need to be provided from the surface of the well (which could be a very significant distance away from the drilling tool).

The well may be an oil, gas, water or geothermal well.

Optionally, the drilling tool is arranged such that the at least one anchoring member is arranged to move radially outwards before (i.e. prior to) the drilling member being moved radially outwards. Optionally, the drilling tool is arranged such that the at least one anchoring member is arranged to move radially inwards after the drilling member has been moved radially inwards.

Preferably, the inner face of the anchoring member is in fluid communication via said hydraulic fluid with the inner face of the drilling member such that both respective inner faces experience the same pressure of the said hydraulic fluid acting upon them. Typically, the inner face of the anchoring member is in fluid communication with the inner face of the drilling member via a hydraulic fluid conduit filled with said hydraulic fluid such that both respective inner faces experience the same pressure of the said hydraulic fluid acting upon them. Typically, the said hydraulic fluid conduit is connected to and is therefore in fluid communication with the supply of hydraulic fluid to the drilling tool.

Typically, the drilling tool is arranged such that the at least one anchoring member is moved radially outwards prior to the drilling member being moved radially outwards. Typically, the drilling tool is arranged such that the drilling member is moved radially inwards prior to the at least one anchoring member being moved radially inwards.

Preferably, the drilling tool comprises a biasing arrangement which ensures that the at least one anchoring member is moved radially outwards prior to the drilling member being moved radially outwards. Preferably, the biasing arrangement is arranged such that the drilling member is moved radially inwards prior to the at least one anchoring member being moved radially inwards.

Optionally, the biasing arrangement comprises at least one and preferably both of:— i) one of more biasing devices which act to bias at least one of and preferably both of the said at least one anchoring member and the drilling member radially inwards; and ii) the relative cross sectional area of the respective inner faces of the said at least one anchoring member and the drilling member.

Typically, the one or more biasing devices comprise one or more springs arranged to bias at least one of and preferably both of the said at least one anchoring member and the drilling member radially inwards, in a direction against the force of the hydraulic fluid acting upon the respective inner face (said hydraulic fluid acting to force and therefore move the respective said at least one anchoring member and the drilling member radially outwards).

Typically, the biasing arrangement is arranged such that a greater resultant inwardly directed force acts upon the drilling member compared with the at least one anchoring member (despite both being exposed to the same pressure of hydraulic fluid from the common downhole hydraulic fluid supply).

Preferably, the biasing arrangement is arranged such that the combination of:— a) the one or more biasing devices of the drilling member and the cross sectional area of the inner face of the drilling member has a greater radially inwards directed force acting upon the drilling member compared with the combination of:— b) the one or more biasing devices of the at least one anchoring member and the cross sectional area of the inner face of the at least one anchoring member.

In other words, preferably, the biasing arrangement is arranged such that the combination of:— a) the one or more biasing devices of the at least one anchoring member and the cross sectional area of the inner face of the at least one anchoring member has a lower radially inwards directed force acting upon the at least one anchoring member compared with the combination of:— b) the one or more biasing devices of the drilling member and the cross sectional area of the inner face of the drilling member.

Optionally, the biasing devices are one or more springs and the spring force of the one or more springs of the at least one anchoring member is lower than the spring force of the one or more springs of the drilling member. In other words, the spring force of the one or more springs of the drilling member is optionally higher than the spring force of the one or more springs of the at least one anchoring member.

Optionally, the cross sectional area of the inner face of the at least one anchoring member is higher than the cross sectional area of the inner face of the drilling member. In other words, the cross sectional area of the inner face of the drilling member is optionally lower than the cross sectional area of the inner face of the at least one anchoring member.

Optionally, the at least one anchoring member comprises fewer springs acting to bias it radially inwards compared with the number of springs acting to bias the drilling member radially inwards. In other words, the drilling member comprises more springs acting to bias it radially inwards compared with the number of springs acting to bias the at least one anchoring member radially inwards.

Preferably, the springs of the drilling member are arranged such that their longitudinal axis is offset from or is not co-axial with the longitudinal axis of the drilling member, such that a plurality of springs can be arranged around the circumference of the drilling member thereby providing embodiments of the drilling tool with the advantage of having a greater number of springs available to increase the biasing force they impart upon the drilling member compared with if only one spring is provided coaxial with and around the longitudinal axis of the drilling member.

Optionally, the drilling tool further comprises a movement mechanism for rotating the drilling member about said longitudinal axis. Preferably, the movement mechanism comprises a mechanical movement mechanism and more preferably comprises a rotational translation movement mechanism arranged to translate rotational movement of a shaft rotatable in use about a longitudinal axis coincident and/or parallel with said longitudinal axis of the drilling tool into rotational movement of the drilling member about its longitudinal axis (which is substantially perpendicular to the longitudinal axis of said drilling tool). Typically, the rotational translation movement mechanism comprises a geared movement mechanism which translates the direction of rotation substantially through 90 degrees. Typically, the geared movement mechanism comprises a bevel gear meshing with a perpendicular bevel gear which together translates the direction of rotation substantially through 90 degrees.

Typically, at least a portion of the said mechanical movement mechanism of the drilling tool is coupled to the downhole torque generator. Preferably, the downhole torque generator comprises a rotatable shaft which provides torque and thus rotational movement and preferably said bevel gear is coupled (either directly or indirectly via a further gear arrangement) to the rotatable shaft. Typically, the rotatable shaft is provided within a separate downhole tool to which the drilling tool is capable of being coupled with.

Preferably, the drilling tool is coupled to a motive assembly comprising the rotatable shaft, wherein operation of the motive assembly rotates the rotatable shaft and which rotates (and provides torque to) said at least a portion of the movement mechanism of the drilling tool. Preferably, operation of the motive assembly rotates the rotatable shaft and which additionally pressurises the downhole hydraulic fluid for supply to the drilling tool.

Preferably, the drilling tool and the motive assembly when connected together are adapted to provide a fixed volume for the downhole hydraulic fluid, where:—

- the drilling tool is adapted to accommodate at least a portion of the said fixed volume of downhole hydraulic fluid at any given time; and
- the motive assembly is adapted to accommodate the remaining portion of the said fixed volume of downhole hydraulic fluid at said given time, and vice versa.

Preferably, the operation of the motive assembly rotates the rotatable shaft and which additionally pressurises the hydraulic fluid for supply to the drilling tool and moves more downhole hydraulic fluid from the motive assembly into the drilling tool and thus moves more of the portion of the said fixed volume of downhole hydraulic fluid at that given time from motive assembly to the drilling tool.

Alternatively, in less preferred embodiments of the present invention, the drilling tool is coupled to a motive assembly having a rotatable shaft, wherein operation of the motive assembly rotates the rotatable shaft and which rotates said at least a portion of the movement mechanism of the drilling tool and where a separate hydraulic fluid pressurisation mechanism is provided which is separate from and independent of the operation of the motive assembly such that pressurisation of the hydraulic fluid for supply to the drilling tool is independent of rotation of the rotatable shaft.

Preferably, the drilling tool is coupled within a Bottom Hole Assembly (BHA).

According to a further aspect of the present invention there is provided a Bottom Hole Assembly (BHA) comprising a drilling tool in accordance with the first aspect of the present invention. Preferably, the BHA comprises a fixed volume of downhole hydraulic fluid contained therein. Typically, the BHA further comprises a motive assembly having a rotatable shaft, wherein operation of the motive assembly rotates the rotatable shaft and which rotates said at least a portion of the movement mechanism of the drilling tool. Preferably, operation of the motive assembly rotates the rotatable shaft and which additionally pressurises the hydraulic fluid for supply to the drilling tool.

Typically said longitudinal axis of the drilling tool is arranged to be substantially co-incident and/or parallel with a longitudinal axis of the oil, gas, water or geothermal well.

Typically, the retracted position of the drilling member results in the drilling member being closer to the longitudinal axis of the drilling tool (compared with the extended position) and the extended position of the drilling member results in the drilling member being further away from the longitudinal axis of the drilling tool (compared with the retracted position).

Preferably, the drilling member is operable to drill through the sidewall of a downhole tubular which may be production tubing, a casing or liner string or a tubular string previously run into the well such as a drill string or other work string. More preferably, the drilling member is operable to drill a port through the sidewall of a downhole tubular.

Preferably, the drill tool is adapted to be run into the well on an elongate member such as a wireline or slick line.

Optionally the motive assembly comprises a battery pack and a motor. Optionally the motive assembly comprises a power control module (PCM) comprising a battery pack and a motor. Optionally the motive assembly comprises a gearbox. Optionally the motive assembly comprises a PCM comprising a battery pack, an electric motor and a gearbox.

The PCM, motor and gearbox can be any kind that are configured to work with a linear actuator. Preferred examples of the PCM, motor and gearbox are described in WO2019/180462A1, the full contents of which are incorporated herein by reference and which are manufactured by and available for purchase from Kaseum®, Aberdeen, UK.

The PCM may be used as the sole power source for the drilling tool. In other words, the drilling tool may be entirely powered by the battery pack within the PCM.

Accordingly, the drilling tool may advantageously be run in on slickline, slick e-line, wireline or any other suitable kind of conveyance method including e-line. Optionally, if the drilling tool is run in on e-line, the e-line may be utilised as a means of transmitting commands and/or data between the drilling tool and more preferably the PCM of the motive assembly and the surface of the wellbore into which the drilling tool is run. Alternatively, the drilling tool and/or the PCM may be pre-programmed with, for example, timing operations that instruct the drilling tool and/or the PCM to e.g. start the motor, without necessarily requiring any instructions or signals to be sent from the surface.

Advantageously the use of a battery pack as the sole power source rather than powering the drilling tool and/or the PCM through e-line means that there is no requirement for a power convertor. Ordinarily a power convertor would be used to supply power via e-line to the PCM and/or the motor connected to the PCM, but the use of a battery pack means that the PCM and/or the drilling tool can operate regardless of power conversion status.

In particular, the battery pack within the PCM can selectively provide electrical power to an electric motor within the motor sub-assembly. Optionally when power is supplied to the electric motor the motor begins to rotate.

The electric motor may be connected via a first end of an input shaft to the gearbox. Rotation of the motor can rotate the input shaft and thereby the gearbox. Optionally the input shaft is coupled at its second end with the drive shaft. Optionally the input shaft is coupled at its second end to a drive coupling assembly. Optionally the drive coupling assembly is coupled to the drive shaft. Optionally the rotational movement of the electric motor is transmitted through the gearbox and drive coupling to the drive shaft, which in turn rotates.

Optionally the drive shaft is part of a rotary assembly that further comprises a linear actuator. Optionally the rotary assembly also further comprises a piston, optionally a hydraulic piston.

Preferably the linear actuator comprises a lead screw and lead screw nut, but this is not limiting and alternative arrangements of linear actuators may be used. For example alternatively the linear actuator may comprise a ball screw and ball nut (where lead screw, lead screw nut and lead screw assembly are used in this disclosure, these terms can be substituted with ball screw, ball nut and ball screw assembly, and vice versa unless otherwise stated). Optionally the lead screw assembly comprises a housing, a lead screw and a lead screw nut.

Optionally the drive shaft comprises at least one torque limiting mechanism which may be in the form of a clutch mechanism. Optionally the clutch mechanism may be a torque-limiting clutch, for example a synchronous torque-limiting clutch and alternatively arranged in a different configuration within the drilling tool. One suitable clutch may be the EASR-Smartic® clutch from Mayr®, Mauerstetten, Germany. Typically, the provision of a torque limiting mechanism provides great power efficiency advantages to the hydraulic fluid piston arrangement in embodiments of the present invention, in that as the torque limiting mechanism disengages, the power demand to the hydraulic piston and thus the electric motor drops off dramatically (in the region of 90%). This is a big benefit in relation to lowering the power consumption of the drilling tool, in that the power consumption of the hydraulic piston arrangement only occurs when the hydraulic pressure is required to be topped up.

Optionally, instead of being arranged between the drive shaft and the lead screw, the torque limiting mechanism may be disposed at one end of the rotary assembly. Optionally the torque limiting mechanism is at least partially engaged with the drive shaft, for example the torque limiting mechanism may be clamped to a portion of the drive shaft. Optionally an end of the torque limiting mechanism is configured to engage with the lead screw. Optionally the torque limiting mechanism is attached, optionally fixedly attached, to an adapter that is arranged between the torque limiting mechanism and the lead screw, and which is optionally configured to engage the lead screw. Optionally an end of the adapter comprises protrusions which inter-engage with castellations on the corresponding end of the lead screw.

Optionally the torque limiting mechanism is configured to slip at a predetermined threshold level of torque (for example, within the range 10-50 Nm, but this can be set as required). Initially, the torque limiting mechanism acts to rotate the drive shaft and the lead screw together. Once the threshold level of torque is reached and/or exceeded, the torque limiting mechanism is configured to slip and thereby allow relative movement between the drive shaft and the lead screw. As above, optionally when a maximum pressure is reached within the drilling tool, the torque limiting mechanism allows the drive shaft and lead screw to slip past each other as described in more detail below.

Optionally the lead screw comprises a throughbore through which the drive shaft of the linear actuator passes. Optionally the drive shaft and the lead screw are coaxially arranged. Optionally the lead screw surrounds at least a portion of the length of the drive shaft.

Optionally as the drive shaft rotates, the engagement with the lead screw results in rotation of the lead screw at the same time. Optionally the lead screw comprises a threaded portion on its outer surface. Optionally the whole outer surface of the lead screw may be threaded. Alternatively, the lead screw may be at least partially threadless.

Optionally the lead screw nut comprises a throughbore and the lead screw nut surrounds at least a portion of the lead screw such that at least a portion of the length of the lead screw is located within the throughbore of the lead screw nut and optionally the lead screw nut, lead screw and drive shaft are coaxial with an axis of the drilling tool.

Optionally an inner surface of the lead screw nut comprises a threaded portion. Optionally the threaded portion of the lead screw nut engages the threaded portion of the lead screw and is optionally complementary to the threaded portion of the lead screw.

Optionally as the drive shaft rotates, the lead screw is in turn rotated and as the lead screw rotates, the lead screw nut moves axially along the lead screw.

Optionally the rotary assembly is balanced to well pressure. Optionally the rotary assembly is configured to convert rotary motion to fluid pressure, optionally hydraulic pressure.

Optionally the lead screw nut is coupled at an end, optionally its lower end (i.e. the end of the lead screw nut that is closer to the drilling module) to the piston. Optionally the lead screw nut and piston are formed from one component. Optionally the lead screw nut and piston are connected together by screws or other fixings.

Optionally the piston comprises a central bore of a first inner diameter. Optionally an end of the piston comprises an aperture of a second inner diameter smaller than the first inner diameter. The aperture is optionally dimensioned to allow the drive shaft to pass through the aperture. The aperture optionally further comprises at least one inner seal, optionally an annular seal such as an o-ring. Optionally the or each inner annular seal is at least partially disposed in a recess formed in the inner surface of the aperture. Optionally the seal creates a sealing engagement between the aperture and the drive shaft. Optionally the o-ring acts to resist fluid ingress to or egress from either side of the piston.

Optionally there is a piston chamber within the rotary assembly, between the hydraulic piston and the drilling module and/or the anchor module. This piston chamber may comprise the fluid that is to be compressed by the hydraulic piston.

Optionally as the lead screw nut moves axially the piston travels with the lead screw nut due to the locking arrangement. Optionally as the gearbox rotates in one direction (for example, counterclockwise), the lead screw nut travels in an axial direction towards the drilling member. Optionally as the gearbox rotates in the opposing direction (for example, clockwise) the lead screw nut travels axially away from the drilling member.

Optionally the piston comprises at least one seal, optionally an annular seal, e.g. an o-ring, on the outer surface of the piston. Optionally the or each outer annular seal is at least partially disposed within a recess formed in the outer surface of the piston. Optionally the piston further comprises at least one seal, optionally an annular seal, in an inner surface of the piston. Optionally the at least one seal on the inner surface of the piston is in sealing engagement with the drive shaft.

Optionally the housing of the lead screw assembly comprises at least one annular groove formed on its inner surface. Optionally the housing of the lead screw assembly comprises a section with a more narrow inner diameter disposed compared to the annular groove and further optionally, the piston chamber comprises a more narrow inner diameter than the said annular groove.

Optionally the drive shaft comprises a splined or castellated end. Optionally the splined or castellated end is configured to connect to a gearing assembly of the drilling tool. Optionally the gearing assembly comprises a corresponding splined or castellated end into which the splined or castellated end of the drive shaft is inserted. Optionally the splined/castellated engagement between the drive shaft and the gearing assembly transmits the rotation of the drive shaft to the gearing assembly which preferably in turn provides rotation to the drilling member. In other words, the drive shaft and the drilling member are rotationally engaged, so that when the drive shaft is rotated (in either direction) the drilling member also rotates. Optionally the rotation of the drilling member is around a longitudinal axis which is perpendicular to the longitudinal axis of the drilling tool.

Optionally rotation of the drive shaft in the second direction retracts the hydraulic piston through reversal of the direction of travel of the linear actuator. This offers the advantage that should the drilling member/gearing assembly become trapped, or stalled, in the well bore, the drive shaft can be rotated in the second direction such that the piston is retracted and fluid pressure within the tool is reduced. Once the fluid pressure is relieved, in the case that the drilling member is trapped, the drilling member can be jarred to free the tool from the tubular and allow retrieval of the tool back to the surface.

Optionally the drilling tool further comprises an anchor module, optionally disposed between the rotary assembly and the drilling module. Optionally the anchor module is in fluid communication with the rotary assembly and/or the drilling module, and preferably comprises one or more anchor chamber(s) or cavity(ies) which are in fluid communication with the piston chamber of the rotary assembly and/or the drilling module. Optionally the anchor module comprises a plurality of anchoring members. Optionally the anchoring members are arranged to extend and/or retract away from/towards the drilling member on the diametrically opposite side of the drilling member from the direction in which the drilling member extends and/or retracts such that extension of the at least one anchor member against the inner surface of the tubular will act to move the drilling member towards the other side of the tubular throughbore, thus moving the drilling member closer to the sidewall of the tubular and therefore reducing the distance through which the drilling member must be extended in order to make contact with the sidewall of the tubular.

Optionally the anchoring members are in the form of anchor pads that move radially outwards from the tool, for example from the anchor module, to anchor the drilling tool. Optionally the anchoring members are actuated by fluid pressure that builds up within the anchor module due to the movement of the piston. Optionally a face and preferably an inner most surface of the anchoring members is in fluid communication with the said anchor chamber(s) or cavity (ies) and typically the anchoring members are actuated by fluid pressure that builds up within the anchor module (preferably the said anchor chamber(s) or cavity(ies) thereof) due to the movement of the piston. Optionally the anchoring members are configured to engage with the inner surface of the target tubular that is to be drilled, e.g. production tubing, casing, liner etc.

The anchoring members are configured to axially fix the drilling tool relative to the target tubular, allowing rotation of the drilling member while resisting axial movement and/or rotation of the rest of the drilling tool during drilling operations.

Optionally as the lead screw is rotated and the piston moves towards the drilling module, the pressure of hydraulic fluid located within a piston chamber increases and said increased fluid pressure is transmitted to hydraulic fluid located in the anchor module and/or the drilling module.

Optionally as fluid pressure builds up in the anchor module and/or the drilling module, fluid may flow into the or each anchor chamber or cavity. Optionally, as the fluid flows into the or each anchor cavity, the fluid pressure pushes against the inner surface of the or each anchor member. Optionally, as the fluid pressure increases, the biasing effect of the anchor member biasing device or devices is overcome and the or each anchor member may move radially outwards. Optionally, as the anchor member moves radially outwards, the anchor member then extends beyond the circumference of the drilling tool and may make contact with the inner surface of the target tubular that is to be drilled through its sidewall.

Optionally, the drilling tool comprises two or more anchor members that are arranged to be directly opposite the drilling member and positioned such that the anchor members are on either side of the drilling axis of the drilling member. In other words, the anchor members may optionally be arranged to make contact with the inner surface of the target tubular on either side of any hole that is drilled through the sidewall of the tubular by the drilling member.

Optionally, the drilling member is mounted on a drilling member axis within a drilling member housing. Optionally, the drilling member axis is aligned perpendicularly to the longitudinal axis of the drilling tool. Optionally, the drilling member is configured to rotate around the drilling member axis. Optionally, the drilling member axis comprises a bearing member acting between the drilling member and the drilling member housing to facilitate rotation therebetween. Optionally, the drilling member is disposed within a cavity formed in the drilling member housing, hereafter referred to as the drilling member cavity. Optionally there is a fluid pathway from the hydraulic fluid piston chamber to the drilling member cavity. Optionally as fluid pressure builds up in the hydraulic fluid located within the piston chamber and/or the anchor module and/or the drilling module, fluid may flow into the drilling member cavity. Optionally, as the fluid flows into the drilling member cavity, the fluid pressure pushes against the inner face of the drilling member (and preferably against the inwardly directed face of a seal which acts between the outer surface of the drilling member and the inner surface of the drilling member cavity) and moves the drilling member radially outwards. As the drilling member moves radially outwards, the drilling member then extends beyond the circumference of the drilling module to make contact with the inner surface of the target tubular that is to be drilled through.

Optionally the drilling member is extended radially outwards incrementally. Optionally the drilling member is moved radially outwards by a first increment under fluid pressure.

Optionally the hydraulic fluid pressure is permitted to increase to a first pre-determined threshold, suitable for radially extending the drilling member and applying force for drilling operations.

Optionally, the fluid pressure continues to increase up to a second pre-determined pressure threshold, at which point the torque limiting mechanism activates and the pressure reduces, or optionally remains at a constant level. Optionally when the fluid pressure reaches the second pre-determined threshold, the torque limiting mechanism is configured to permit the drive shaft to effectively disengage from the lead screw, so that the drive shaft may rotate without further rotation of the lead screw. Optionally, when the torque limiting mechanism is activated and the drive shaft and lead screw lose mutual frictional force, the fluid pressure within the drilling module may reduce (due to increased volume as the drilling member extend radially outwards), or optionally it may stay at or very close to the pre-determined threshold.

Advantageously, by preventing fluid pressure within the drilling module exceeding the second pre-determined threshold, the risk of damage to the drilling module or more particularly to the drilling member itself (for example stalling or breakage of the drilling member) is significantly reduced. Furthermore, the fluid pressure is maintained at a sufficiently high level to allow the drilling member to engage with the tubular that is to be drilled—if the fluid pressure was too low, the drilling member may not apply sufficient pressure to the tubular and the drilling process could be detrimentally affected.

The position of the first increment may be sufficient to begin making a first hole in the wall of the tubular. Optionally the drilling member extends at least partially into the wall of the tubular.

As the hydraulic pressure is maintained and/or increased, the drilling member is forced further radially outwards from the drilling module and the drilling member can then drill further into the wall of the tubular to form a deeper hole in the wall of the tubular.

This process may continue until the drilling member has fully drilled through the sidewall of the tubular to form a hole through the sidewall therein.

Optionally the drilling tool can be pre-programmed with, for example, a running time that has been pre-determined to provide sufficient time to complete the drilling operation.

When the drilling operation is completed and the drilling tool is to be retrieved from the wellbore, optionally firstly the drilling member and the subsequently thereafter the anchor members can be retracted. Optionally, to achieve this, the rotary assembly can change from a driving configuration to a retraction configuration.

Optionally, in the retraction configuration, the direction of rotation of the drive shaft is reversed. Optionally the reversal of rotation of the drive shaft similarly reverses the rotation of the lead screw. The lead screw nut then optionally moves axially in a direction away from the drilling module/anchor module. Optionally the hydraulic piston is coupled to or is integral with the lead screw nut and the axial travel of the lead screw nut optionally also causes the hydraulic piston to retract away from the drilling module or anchor module. Optionally as the piston retracts, the volume of the piston chamber within the rotary assembly increases. Optionally as the piston retracts, it passes through and seals against the more narrow inner surface section of the housing toward the annular groove of the housing.

Typically, as the piston moves towards the drilling tool (drilling module/anchor module assembly), the volume of the piston chamber decreases and the fluid pressure behind the piston (and in the anchor module/drilling module) increases. Typically, as the piston moves away from the drilling tool (drilling module/anchor module assembly), the volume of the piston chamber increases and the fluid pressure behind the piston (and in the anchor module/drilling module) decreases.

As the fluid pressure reduces in the drilling module, firstly the drilling member retracts into the chassis of the drilling module (prior to the anchor members retracting).

As the fluid pressure further reduces in the drilling and/or anchor module, secondly the anchor members retract into the chassis of the respective drilling and/or anchor module (but only after the drilling member has fully retracted into the chassis of the drilling module).

The retraction of the firstly the drilling member and then subsequently the anchor members acts to reduce the risk of the drilling tool getting stuck downhole, which would then necessitate intervention measures with the associated loss of operative time and costs.

Additionally, the drilling member and/or the anchor members preferably comprise a biasing arrangement which may be in the form of a resilient device or devices such as a spring return mechanism configured to retract the drilling member. The use of resilient devices biased towards retraction of the drilling member and/or the anchor members may be particularly useful in shallow drilling applications, where there is little/no hydrostatic pressure to assist with the retraction of the drilling member and/or the anchor members.

Optionally, the piston continues to be retracted until the seals of the piston are aligned with the annular groove. Optionally alignment with the annular groove allows fluid to move in the space between the more narrow inner surface section of the housing and the first annular groove.

Optionally, the tool comprises a shear relief arrangement that allows for emergency venting of the tool should the tool fail. Optionally the shear relief arrangement may be disposed at an end of the drilling tool and optionally between the connection of the anchor module and the rotary assembly. Optionally, the shear relief arrangement may comprise one or more frangible fasteners, optionally threaded fasteners such as shear screws. Optionally the frangible fasteners pass through apertures in an end of the rotary assembly and optionally one of the lead screw assembly housing and preferably the piston housing and into the end of the anchor module connected to the end of the piston housing. Optionally the frangible fasteners partially extend into the wall of the anchor module.

Optionally in the event that the tool fails—for example it stalls, or it becomes trapped or jammed in the tubular—the tool can be jarred upwards (towards the surface). Jarring the tool breaks the frangible fasteners between the piston housing and the anchor module. Optionally the piston housing can then move relative to the anchor module. Optionally the piston housing moves partially axially away from the anchor module while remaining connected to the anchor module. Optionally the shear relief arrangement including the snap ring and the spin collar moves with the piston housing in an uphole direction. Optionally the aperture through the piston housing in which the frangible fastener is disposed at least partially aligns with an annular seal around the end of the anchor module, unseating the annular seal from the groove.

This allows venting of the fluid within the tool into the wellbore. Where the drilling module comprises resilient devices such as springs, these resilient devices bias the drilling member to radially retract into the drilling module. Similarly, the anchor members preferably comprise resilient devices to bias the anchor members to radially retract into the anchor module. The tool may then be recovered to surface.

Optionally the current being provided to the tool by the battery pack can be monitored during the drilling operation. In some circumstances, for example if the drill becomes stuck or becomes caught stuck in swarf during the drilling operation. This can be detected by a spike in the current to the tool (for example, 1-2A during ordinary usage rapidly spiking to 3-5A).

Continuing to increase fluid pressure and apply force to the drilling member in the event that the drilling member has jammed is undesirable, as this could lead to damage to the tool. Optionally, therefore, a threshold value for the current is pre-set (optionally within the tool, for example within the PCM). Optionally, when the current exceeds the predetermined threshold, rotation of the motor is reversed for a first predetermined period.

Optionally, reversal of the motor and therefore reverse rotation of the drive shaft, reduces fluid pressure within the tool due to retraction of the piston. Optionally, reduction in fluid pressure allows the drilling member to retract at least partially.

Optionally, reversal of the motor and drive shaft reduces the force applied by fluid pressure on the drilling member.

Optionally, there may be an additional period of time after completion of the first predetermined period, but before the drilling operation restarts, where no rotation is occurring. Including a rest period between changes in rotational direction may advantageously help to protect the motor and prolong its operational lifetime.

According to an aspect of the present invention there is provided a method for drilling through a sidewall in a tubular in a well, the method comprising:

deploying a drilling tool into the wellbore to the depth at which the sidewall of the tubular is to be drilled, wherein the drilling tool comprises:

one or more anchor members, a drilling member and a drive shaft rotatably connected to the drilling member;

the method further comprising:

rotating the drive shaft and thereby rotating the drilling member around an axis perpendicular to the longitudinal axis of the drilling tool; and applying fluid pressure to an inner face of the one or more anchor members to firstly move the one or more anchor members radially into contact with the inner throughbore of the wellbore in response to modification of the fluid pressure; and applying fluid pressure to an inner face of the drilling member to secondly move the drilling member radially in response to modification of the fluid pressure.

Typically, the drilling tool is connected to a motive assembly wherein the method further comprises operation of the motive assembly which causes rotation of a drive shaft and modifies fluid pressure within the drilling tool. Preferably, the motive assembly is battery powered.

According to a further aspect of the present invention there is provided a method for drilling through a sidewall in a tubular in a well, the method comprising:

deploying a drilling tool into the wellbore to the depth at which the sidewall of the tubular is to be drilled, wherein the drilling tool comprises:

one or more anchor members and a drilling member and a battery powered motive assembly, wherein operation of the motive assembly rotates a drive shaft and modifies fluid pressure within the drilling tool;

the method further comprising:

rotating the drive shaft and thereby rotating the drilling member around an axis perpendicular to the longitudinal axis of the drilling tool; and applying fluid pressure to an inner face of the one or more anchor members to firstly move the one or more anchor members radially into contact with the inner throughbore of the wellbore in response to modification of the fluid pressure; and applying fluid pressure to an inner face of the drilling member to secondly move the drilling member radially in response to modification of the fluid pressure.

The accompanying drawings illustrate presently exemplary embodiments of the disclosure and together with the general description given above and the detailed description of the embodiments given below, serve to explain, by way of example, the principles of the disclosure.

In the description that follows, like parts are marked throughout the specification and drawings with the same reference numerals, respectively. The drawings are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments of the present invention are shown in the drawings and herein will be described in detail, with the understanding that the present disclosure is to be considered an exemplification of the principles of the invention and is not intended to limit the invention to that illustrated and described herein. It is to be fully recognized that the different teachings of the embodiments discussed below may be employed separately or in any suitable combination to produce the desired results.

The following definitions will be followed in the specification. As used herein, the term "wellbore" refers to a wellbore or borehole being provided or drilled in a manner known to those skilled in the art. The wellbore may be 'open hole' or 'cased', being lined with a tubular string. Reference to up or down will be made for purposes of description with the terms "above", "up", "upward", "upper" or "upstream" meaning away from the bottom of the wellbore along the longitudinal axis of a work string toward the surface and "below", "down", "downward", "lower" or "downstream" meaning toward the bottom of the wellbore along the longitudinal axis of the work string and away from the surface and deeper into the well, whether the well being referred to is a conventional vertical well or a deviated well and therefore includes the typical situation where a rig is above a wellhead and the well extends down from the wellhead into the formation, but also horizontal wells where the formation may not necessarily be below the wellhead. Similarly, 'work string' refers to any tubular arrangement for conveying fluids and/or tools from a surface into a wellbore. In the present invention, slickline or wireline is the preferred work string (but e-line and/or slick e-line can also be employed).

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention.

Also, optional features described in relation to one embodiment can typically be combined alone or together with other features in different embodiments of the invention. Additionally, any feature disclosed in the specification can be combined alone or collectively with other features in the specification to form an invention.

Various embodiments and aspects of the invention will now be described in detail with reference to the accompanying figures. Still other aspects, features and advantages of the present invention are readily apparent from the entire description thereof, including the figures, which illustrates a number of exemplary embodiments and aspects and implementations. The invention is also capable of other and different embodiments and aspects and its several details can be modified in various respects, all without departing from the scope of the present invention as defined by the claims.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

Accordingly, the drawings and descriptions are to be regarded as illustrative in nature and not as restrictive. Furthermore, the terminology and phraseology used herein is solely used for descriptive purposes and should not be construed as limiting in scope. Language such as "including", "comprising", "having", "containing" or "involving" and variations thereof, is intended to be broad and encompass the subject matter listed thereafter, equivalents and additional subject matter not recited and is not intended to exclude other additives, components, integers or steps. In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including" or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention as defined by the claims.

All numerical values in this disclosure are understood as being modified by "about". All singular forms of elements, or any other components described herein including (without limitations) components of the downhole tool are understood to include plural forms thereof and vice versa.

Figure 4:
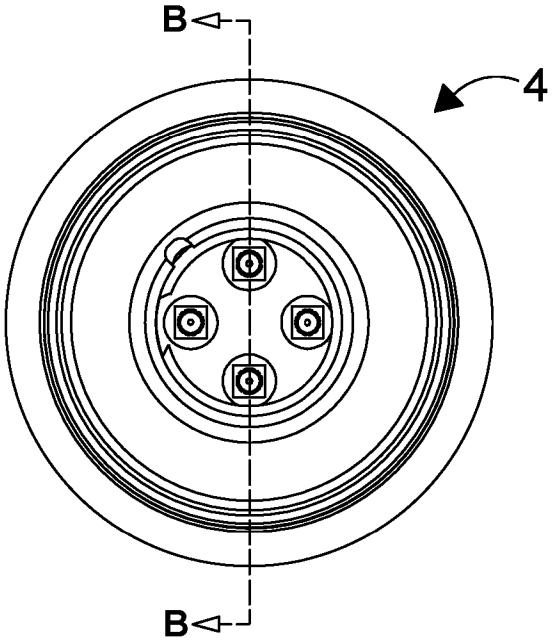
FIG. 4 shows a schematic end view of an example of an electric motor which is connected at one (uphole) end to the PCM of FIG. 1 and at the other (downhole) end is connected to the gearbox of FIG. 7 and which in some embodiments forms part of a drilling tool in accordance with the present invention and in other embodiments is connected to a drilling tool in accordance with the present invention.
Figure 8:
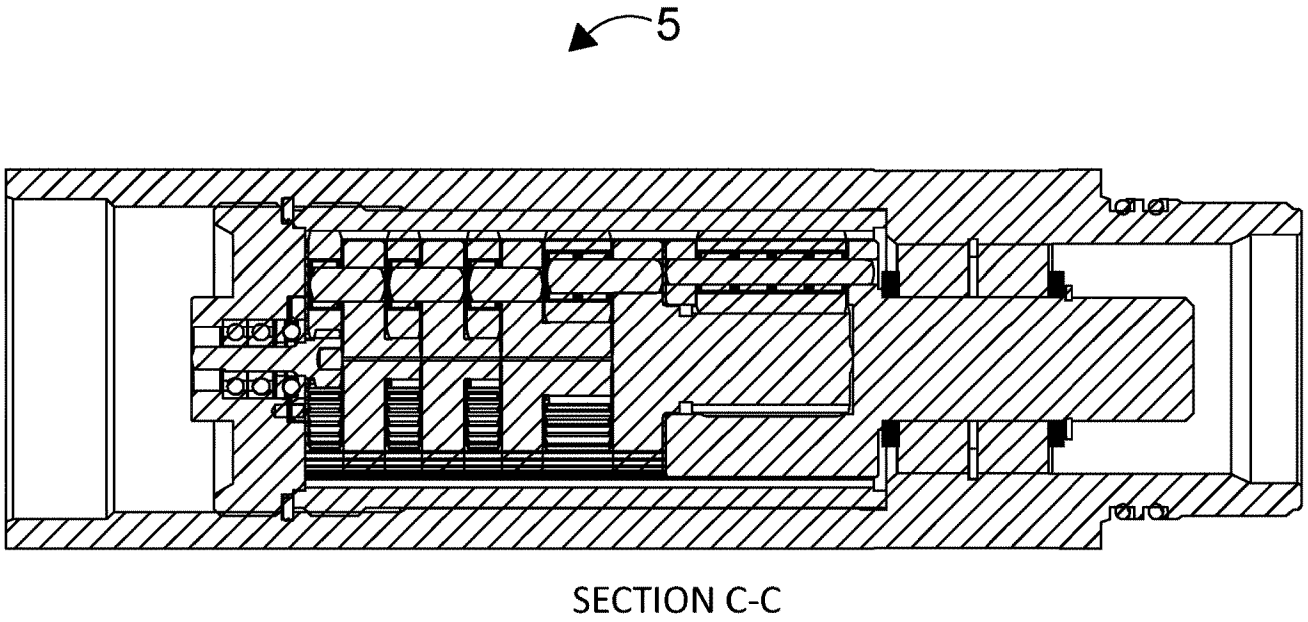
FIG. 8 shows a schematic cross-sectional representation through section C-C of the gearbox of FIG. 7.
Figure 7:
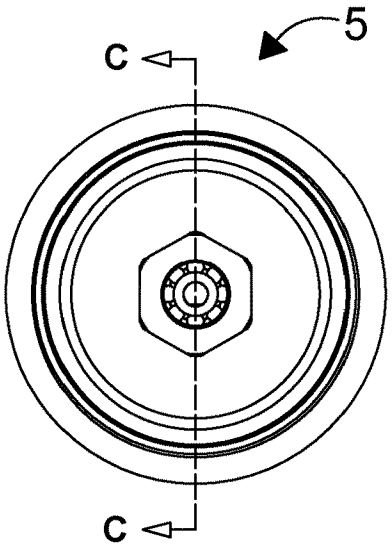
FIG. 7 shows a schematic end view of an example of a gearbox which is connected at one (uphole) end to the electric motor of FIG. 4 and at the other (downhole) end is connected to the rotary assembly of FIGS. 9 & 10 and which in some embodiments forms part of a drilling tool in accordance with the present invention and in other embodiments is connected to a drilling tool in accordance with the present invention.
Figure 10:
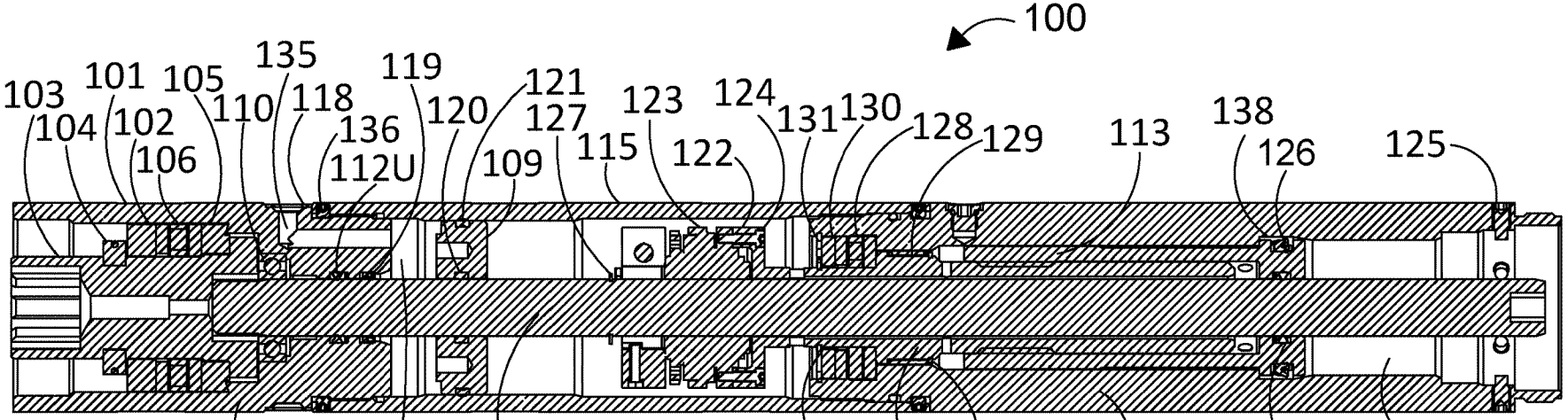
FIG. 10 shows a schematic cross-sectional representation through section D-D of the rotary assembly of FIG. 9.
Figure 11:
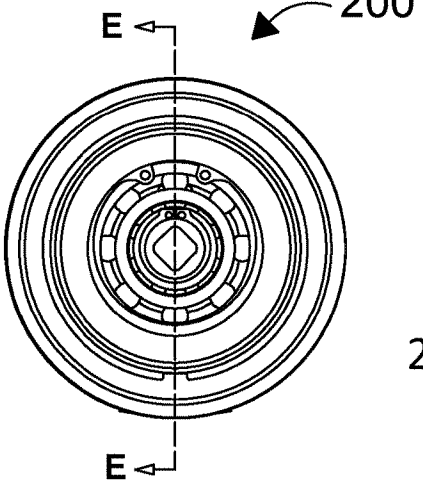
FIG. 11 shows an (upper) end view of an anchor module of a drilling tool in accordance with the present invention, having one (uphole) end for attachment to rotary assembly of FIG. 10 (and in turn the gearbox of FIG. 7, the electric motor of FIG. 4 and the PCM of FIG. 1) and having another (downhole) end for attachment to the drilling module of FIG. 16.
Figure 17:
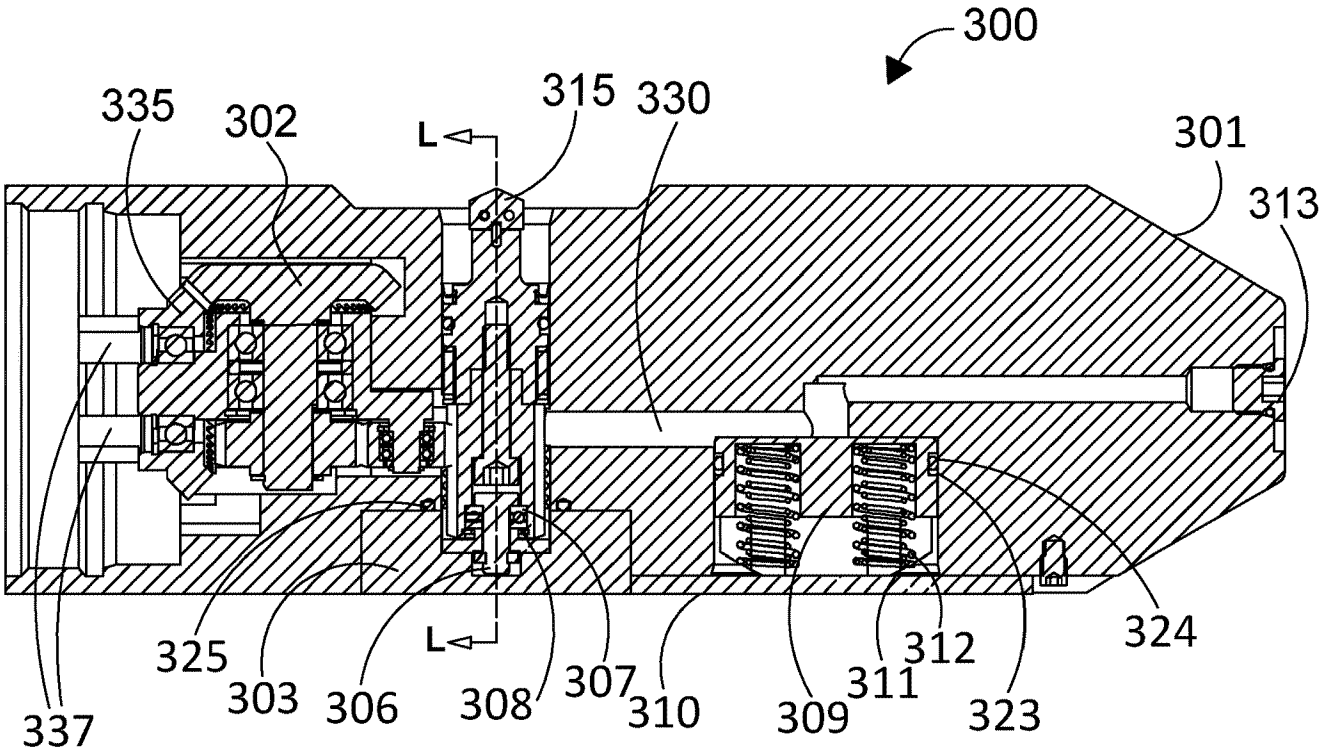
FIG. 17 shows a schematic cross sectional view through section F-F of the drilling module of FIG. 16, with the drilling member in the retracted (running in) position.
Figure 16:
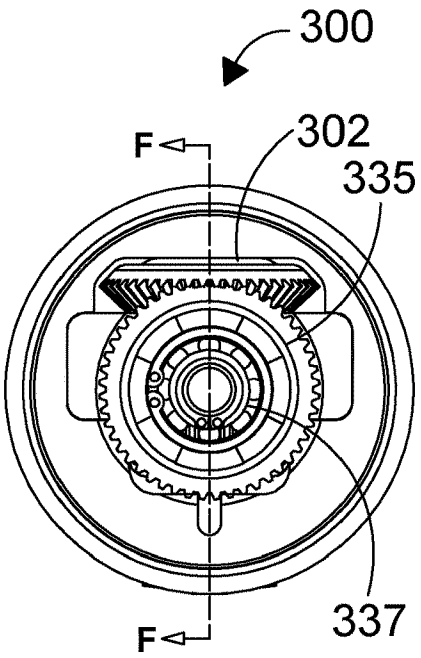
FIG. 16 shows an (upper) end view of a drilling module of a drilling tool in accordance with the present invention, having one (uphole) end for attachment to the anchor module of FIG. 11 (and in turn the rotary assembly of FIG. 9, the gearbox of FIG. 7, the electric motor of FIG. 4 and the PCM of FIG. 1)
Figure 18:
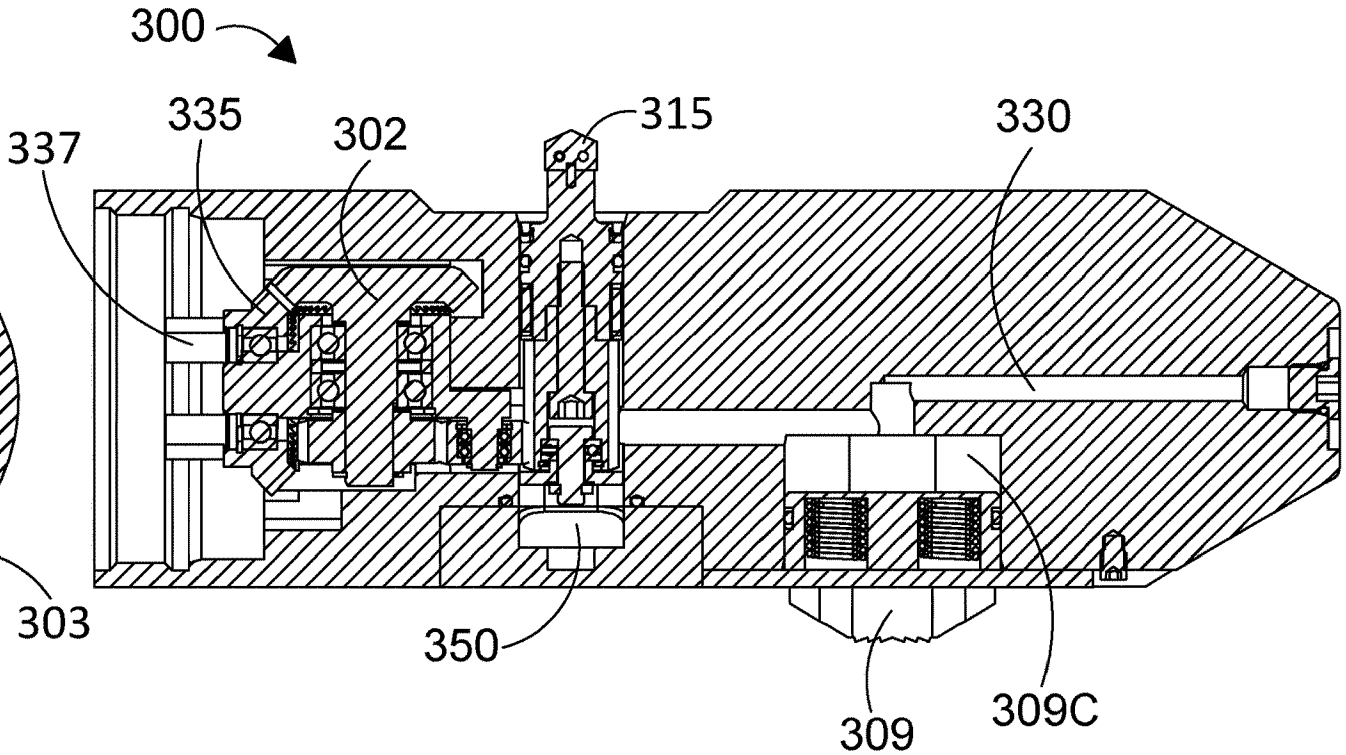
FIG. 18 shows a schematic cross sectional view through section F-F of the drilling module of FIG. 16, with the drilling member in the extended (drilling) position.
Figure 22:
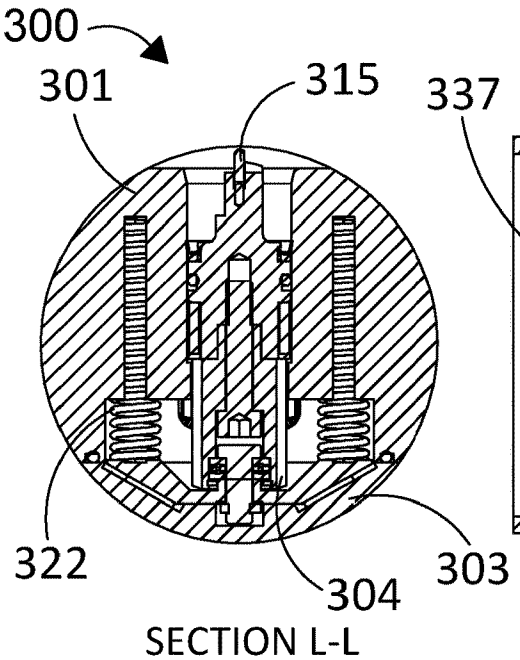
FIG. 22 shows a schematic cross sectional end view through section L-L of the drilling module of FIG. 17, with the drilling member in the retracted (running in) position.
Figure 23:
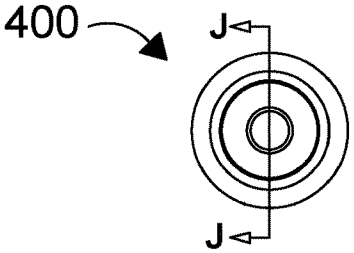
FIG. 23 is an end view of the entire made up drilling bottom hole assembly (BHA) to be run into a wellbore in order to drill one or more holes in the sidewall of a downhole tubular or formation.
Figure 25:
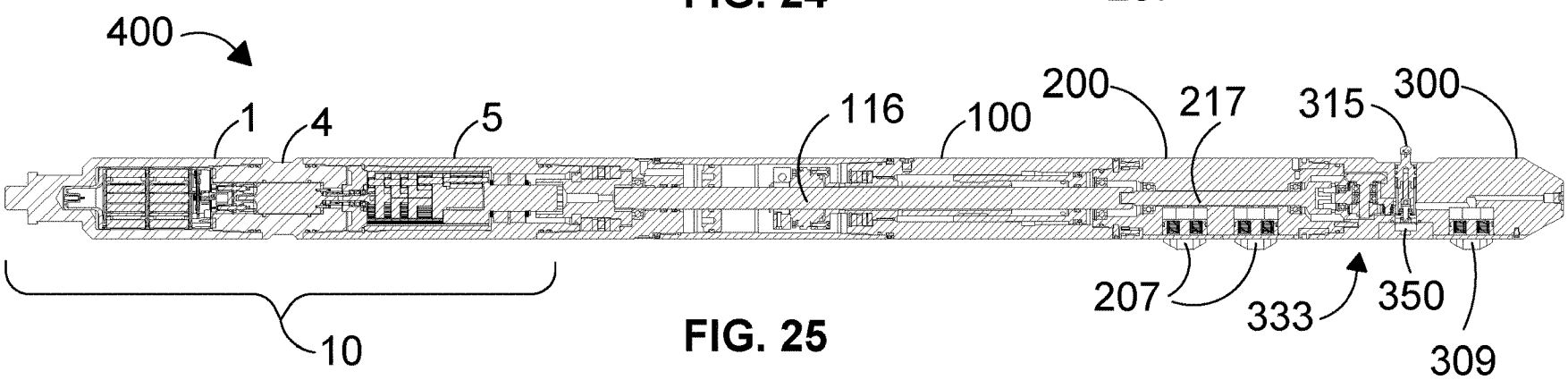
Figure 27:
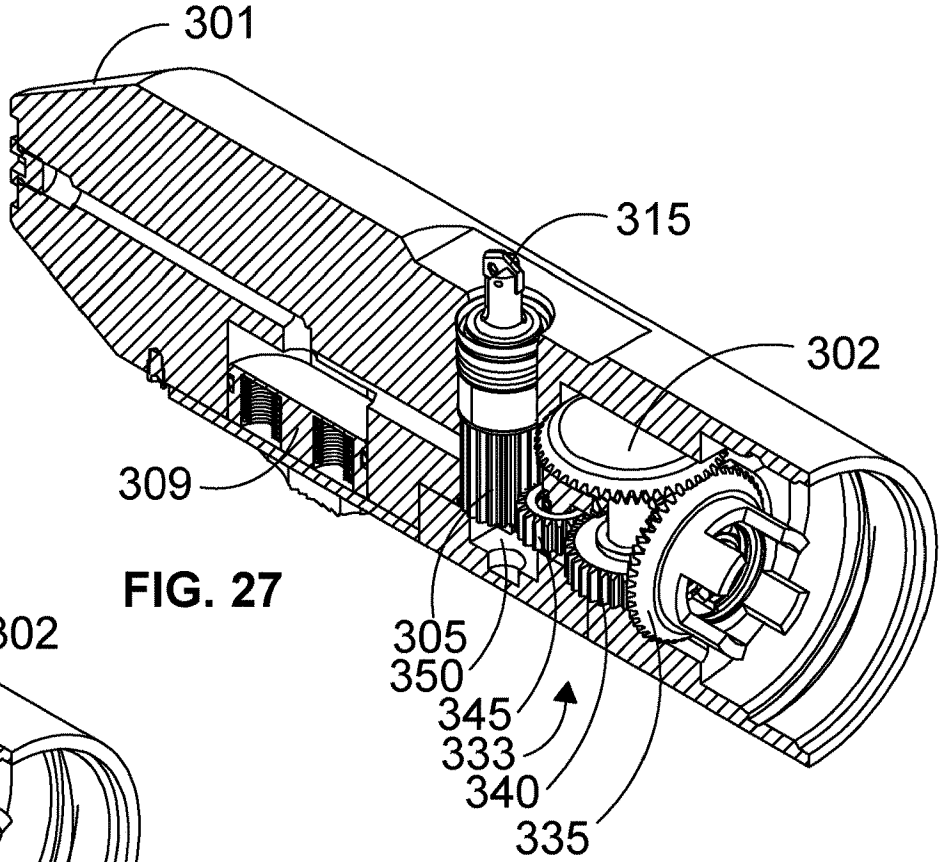
Figure 26:
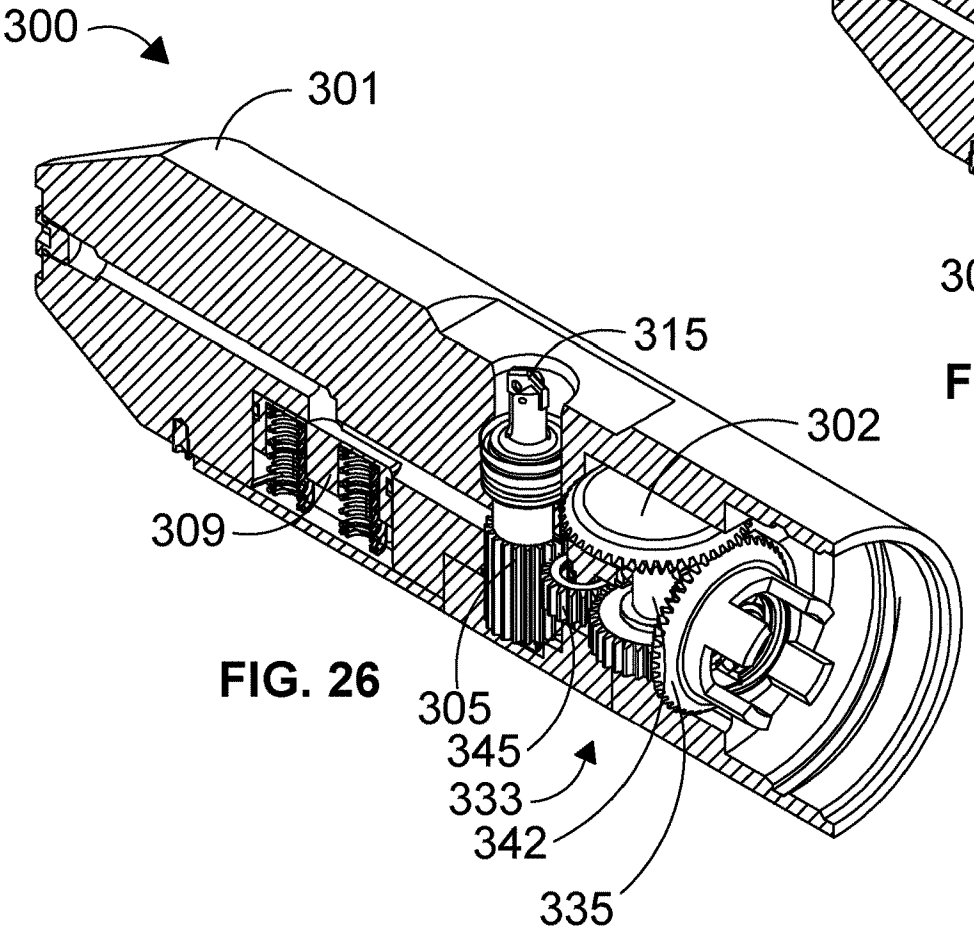
Figure 29:
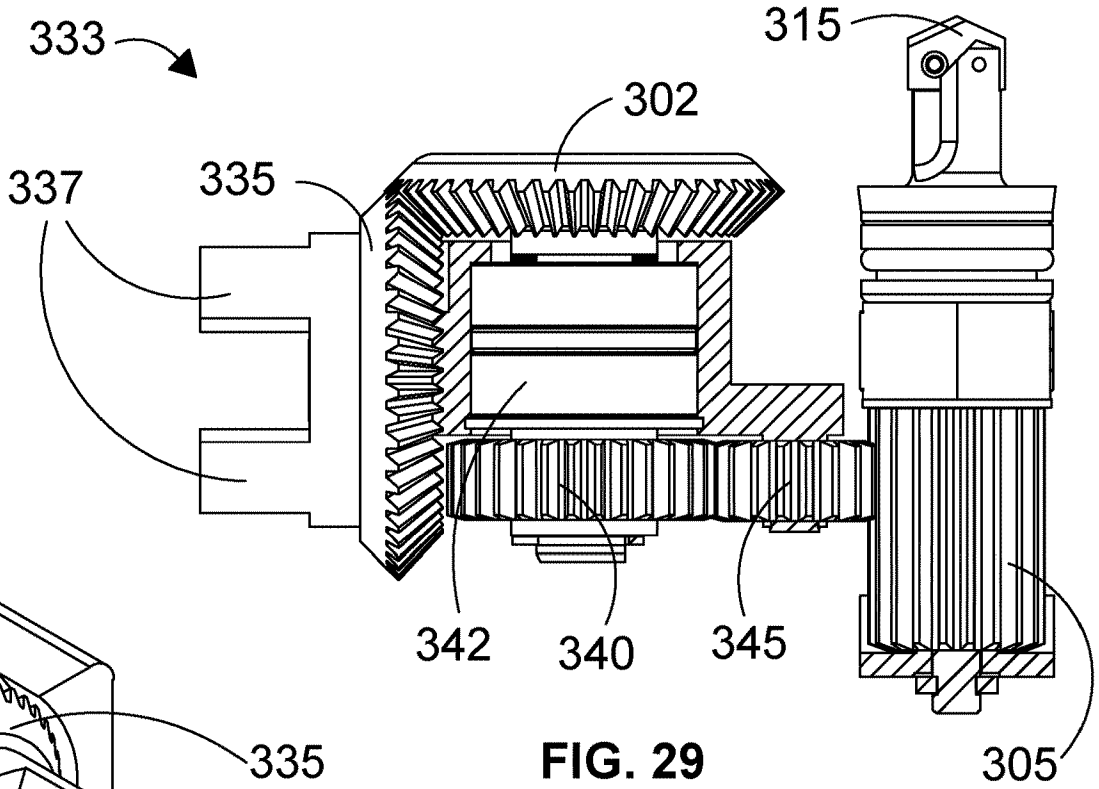
Figure 28:
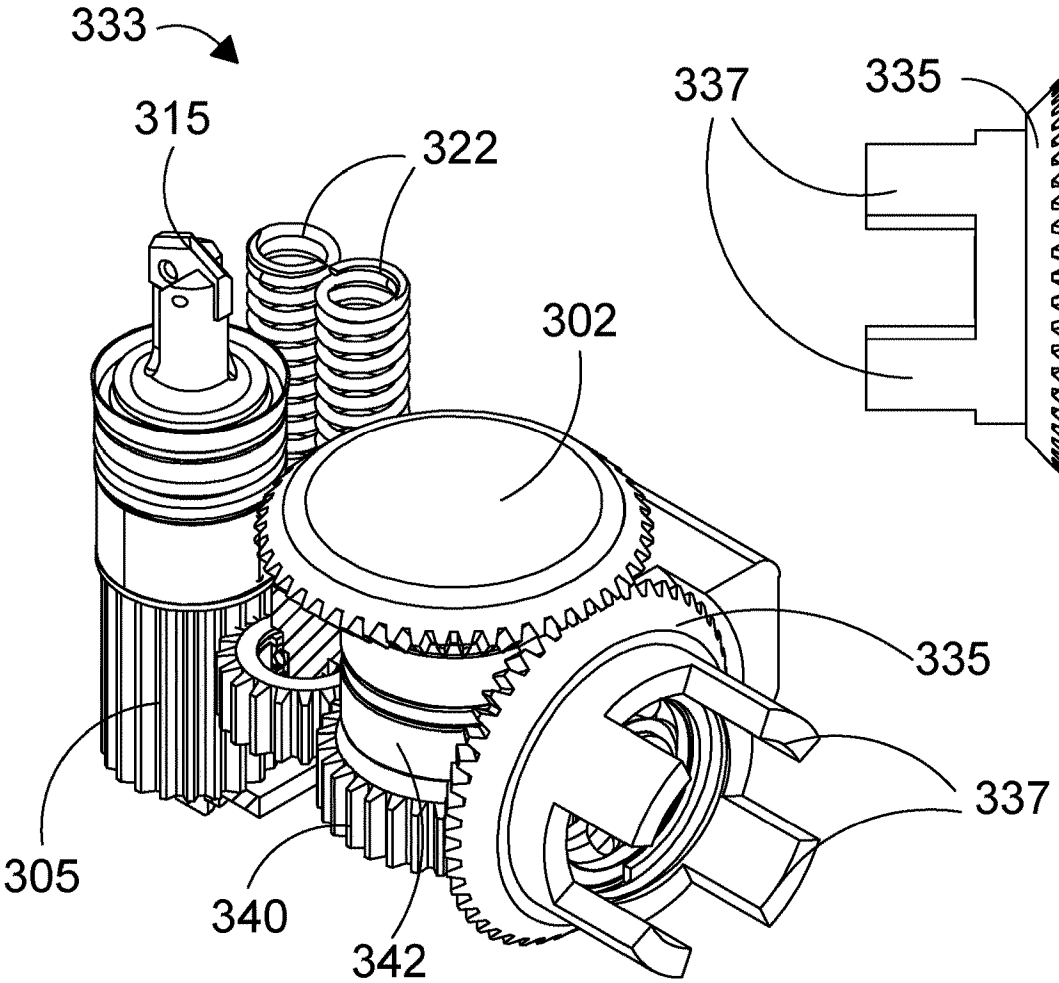
Figure 30:
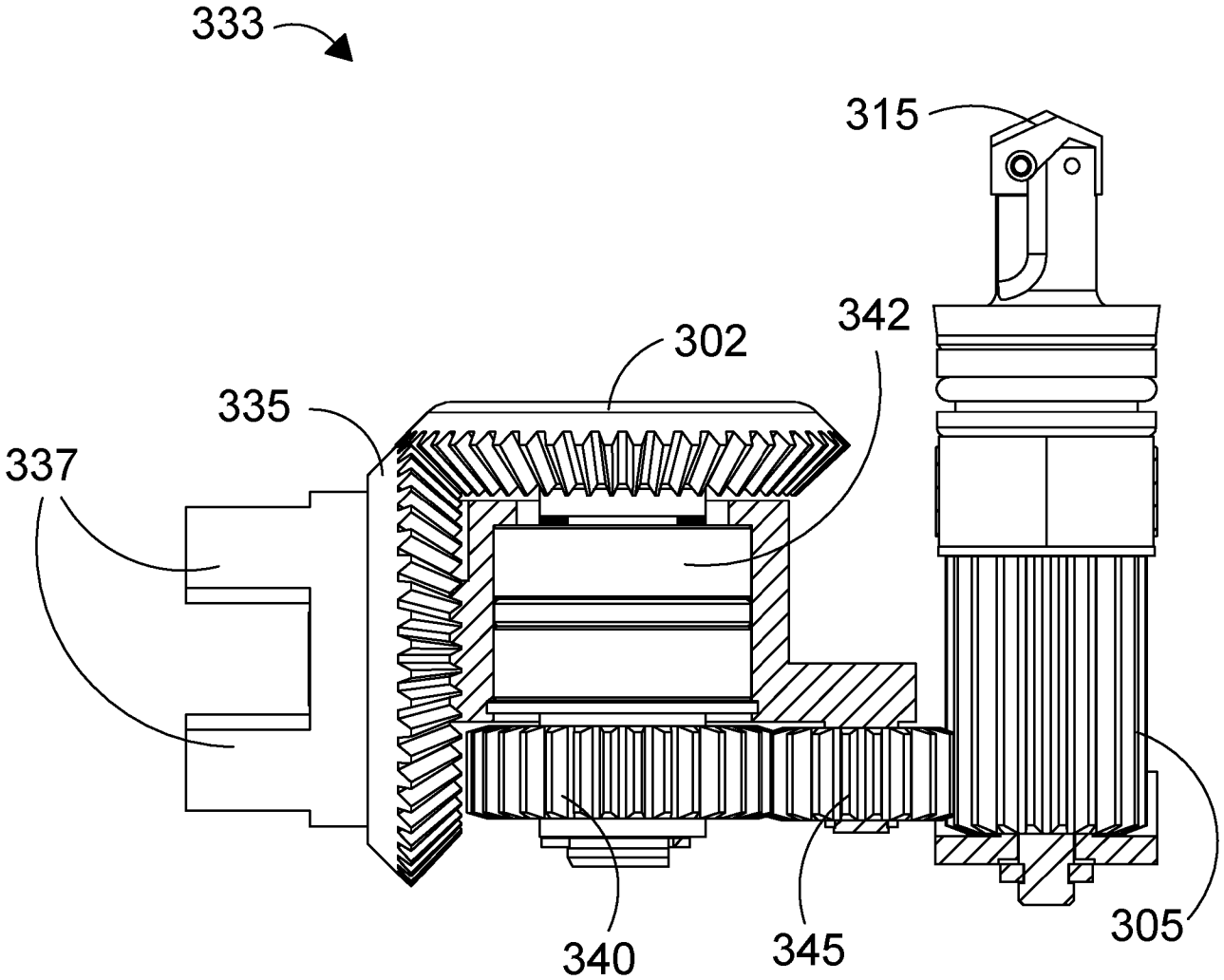

the electric motor of FIG. 4;

the gearbox of FIG. 7;

the rotary assembly of FIG. 10;

the anchor module of the drilling tool in accordance with the present invention of FIG. 11; and the drilling module of the drilling tool in accordance with the present invention of FIG. 16;

and where the anchor members of the anchor module and the drilling member of the drilling module are all in the retracted (running in) position;

FIG. 25 shows a schematic cross sectional side view through section J-J of the entire made up drilling BHA of FIG. 23, where the anchor members of the anchor module and the drilling member of the drilling module are all in the extended (anchored and drilling) position;

FIG. 26 shows the drilling module of FIG. 17 but is shown from the other end and is also shown in a part-cross sectional perspective side view, where the gearing mechanism of the drilling module is fully shown (i.e. it is not in cross-section), with the drilling member in the retracted (running in) position;

FIG. 27 shows the drilling module of FIG. 18 but is shown from the other end and is also shown in a part-cross sectional perspective side view, where the gearing mechanism of the drilling module is fully shown (i.e. it is not in cross-section), with the drilling member in the extended (drilling) position;

FIG. 28 shows a portion of the drilling module of FIG. 26, particularly showing a perspective side view of the gearing mechanism and the drilling member, with the drilling member in the retracted (running in) position;

FIG. 29 shows a side view of the gearing mechanism and the drilling member of FIG. 26, particularly showing a side view of the gearing mechanism and the drilling member, with the drilling member in the retracted (running in) position; and FIG. 30 shows a side view of the gearing mechanism and the drilling member of FIG. 27, particularly showing a side view of the gearing mechanism and the drilling member, with the drilling member in the extended (drilling) position.

DETAILED DESCRIPTION OF EXAMPLES OF THE INVENTION

Figure 9:
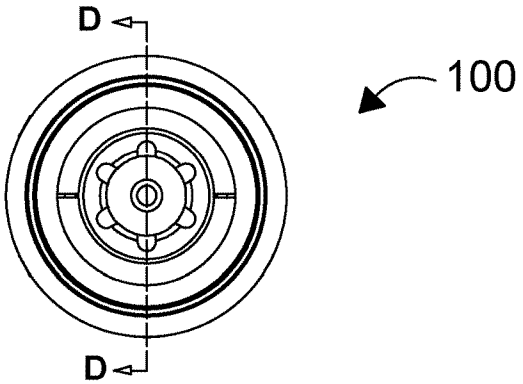
FIG. 9 shows an end view of a rotary assembly comprising a lead screw assembly incorporating a clutch, for attachment to the gearbox of FIG. 7 (and in turn the electric motor of FIG. 4 and the PCM of FIG. 1) at one (uphole) end and for further attachment to the anchor module of FIG. 11 of a drilling tool in accordance with the present invention at the other (downhole) end, and which in some embodiments forms part of a drilling tool in accordance with the present invention and in other embodiments is connected to a drilling tool in accordance with the present invention.
Figure 24:
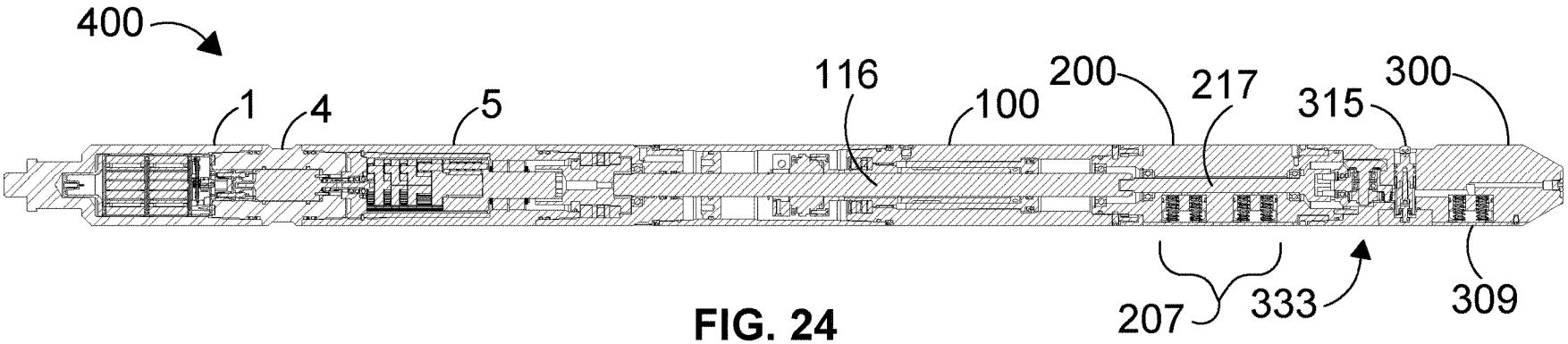
FIG. 24 shows a schematic cross sectional side view through section J-J of the entire made up drilling BHA of FIG. 23, the drilling BHA consisting of (from left to right):— the PCM of FIG. 1.

FIGS. 1-8 illustrate examples of a power control module (PCM) 1 comprising a housing 2 and a battery pack 3, motor 4 and gear assembly 5 (in this example, a planetary gear assembly) that are configured to work with a linear actuator/rotary assembly 100 of FIGS. 9 and 10, and are therefore suitable for use with a drilling tool 200, 300 (of FIGS. 11 to 30) in accordance with the present invention to make up a drilling bottom hole assembly (BHA) 400 as shown in FIGS. 24 and 25.

Examples of the modular components (i.e. PCM 1, battery pack 3, motor 4 and gearbox assembly 5) were disclosed in PCT Patent Application No WO2019/180642, the full contents of which are incorporated herein by reference and which are manufactured by and available for purchase from Kaseum®, Aberdeen, UK.

Figure 2:
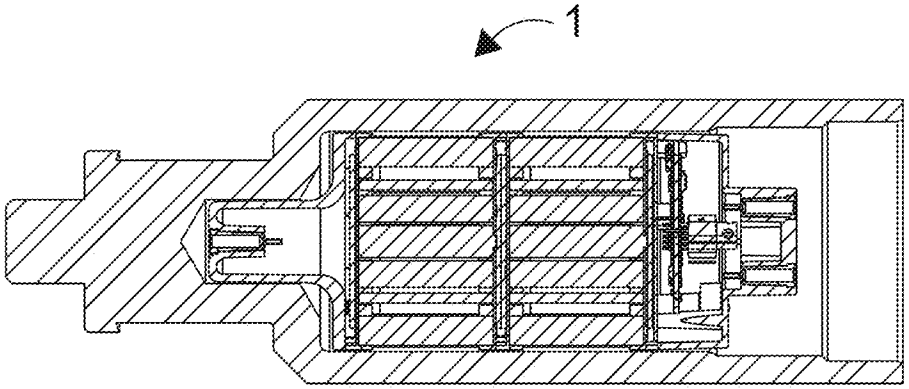
FIG. 2 shows a schematic cross-sectional representation through section A-A of the PCM of FIG. 1.
Figure 3:
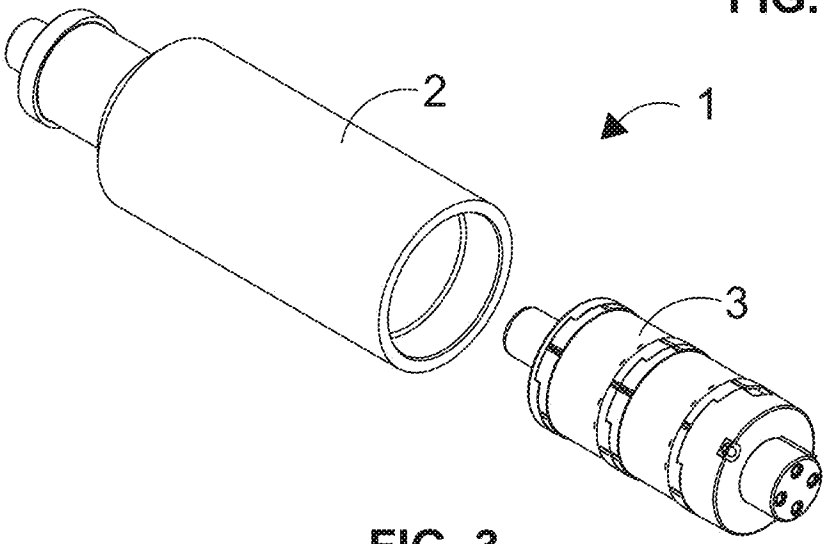
FIG. 3 shows a schematic perspective, partially-exploded view of the PCM of FIGS. 1 and 2.
Figure 1:
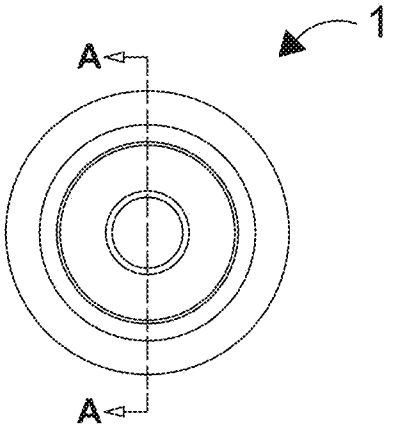
FIG. 1 shows a schematic end view of an example of a PCM which is connected to the electric motor of FIG. 4 and which in some embodiments forms part of a drilling tool in accordance with the present invention and in other embodiments is connected to a drilling tool in accordance with the present invention.
Figure 5:
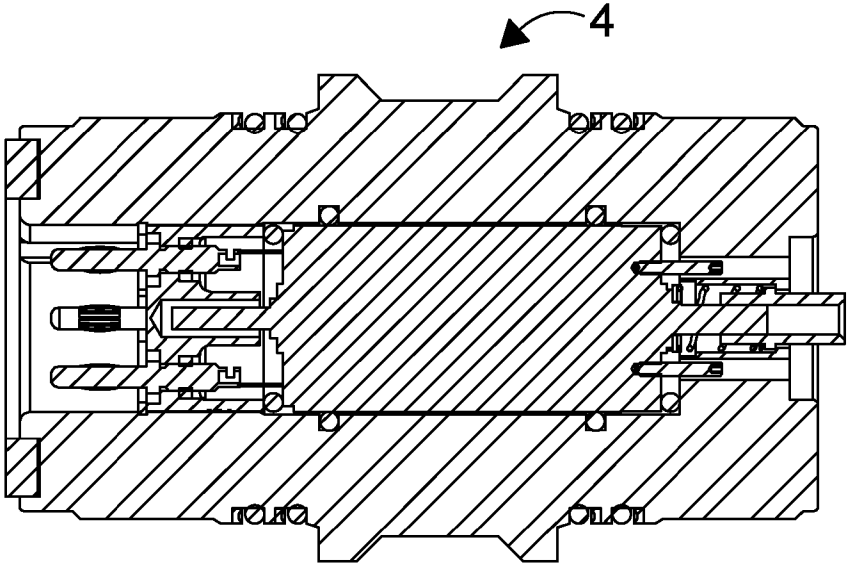
FIG. 5 shows a schematic cross-sectional representation through section B-B of the electric motor of FIG. 4.
Figure 6:
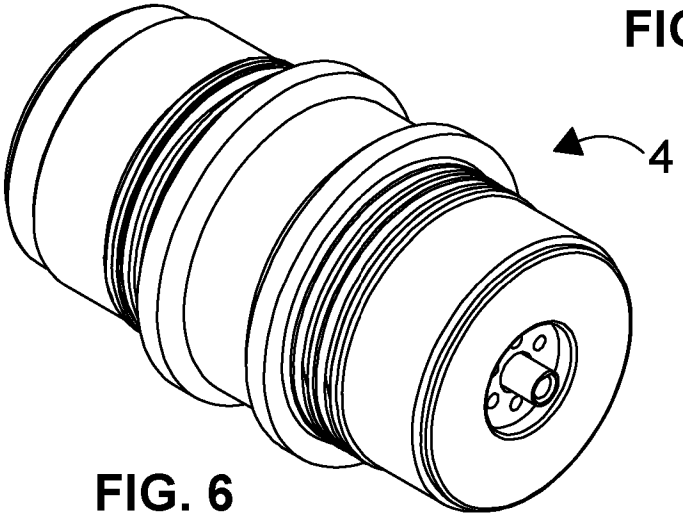
FIG. 6 shows a schematic perspective view of the electric motor of FIGS. 4 and 5.

The use of these components in the drilling BHA 400 described below allows the drilling BHA 400 to be run into a well on slickline (not shown but which is attached to the upper most end (i.e. the end as shown in FIG. 1 and the left hand end as shown in FIG. 2 of the PCM 1)) rather than wireline or e-line/slick e-line, as power is supplied to the tool by the on-board battery pack of the PCM 1 as opposed to sent down the line from the surface. However, if the drilling BHA 400 is run in on e-line, for example, the e-line may be utilised as a means of transmitting commands and/or data between the tool and the surface of the wellbore into which the tool is run.

FIG. 9 shows an example of a particularly power efficient linear actuator/rotary assembly 100 which may be used in between the gearbox assembly 5 and the anchor module 200 to power the drilling module 300 to drill through the sidewall of casing or other pipes/tubulars in a downhole environment such as an oil, gas, water or geothermal well. For simplicity "tubular" will be used as a general term in this description, but the skilled reader will understand that this extends to any form of pipe, tubing, casing or even the formation itself etc. that may be located downhole.

As will be described subsequently, the power efficient linear actuator/rotary assembly 100 has two main functions, being:— a) providing a rotary drive output (which in this embodiment is a lowermost (in use) end of drive shaft 116 of the linear actuator/rotary assembly 100) which is coupled to a rotary drive input (which in this embodiment is an uppermost (in use) end of drive shaft 217 of the drilling tool 200, 300) to thereby provide rotation to a drilling member (which in this embodiment is a drilling member 315 of the drilling tool 200, 300); and b) providing a means to pressurise a source of hydraulic fluid within a closed loop system wholly located within the drilling BHA 400 (such that there is a distinct volume of hydraulic fluid located within a sealed volume provided within the BHA 400 but which is in contact with inner faces of at least one anchoring member 207 and the drilling member 315 and which distinct volume of hydraulic fluid is separated or isolated from external downhole fluid such as drilling mud or fluid or reservoir fluid etc. by means of a seal system) where the means to pressurise the said source of hydraulic fluid is provided in this embodiment by axial movement occurring of a main piston 113 from left to right as shown in FIG. 10 (which is caused by rotation of the drive shaft 116 of the linear actuator/rotary assembly 100) which results in the hydraulic fluid located in chamber 137 of the linear actuator/rotary assembly 100 being pressurised (i.e. its pressure increases due to the volume of the chamber 137 being decreased by said left to right movement of the main piston 113) and that pressurised hydraulic fluid is used to move both:— at least one anchoring member 207; and the drilling member 315 radially by means of the hydraulic fluid acting upon respective inner faces thereof in order to move the at least one anchoring member 207 and the drilling member 315 into or out of contact with the inner surface of the well.

The closed loop supply of hydraulic fluid is wholly contained within the drilling BHA 400 such that the entire volume of the closed loop supply of hydraulic fluid is wholly contained within the drilling BHA 400 and thus provides the great advantage that embodiments of the present invention of drilling BHA 400 do not require a hydraulic fluid supply conduit extending up to the surface of the well. Accordingly, the coupling together of the linear actuator/rotary assembly 100 to the drilling tool 200, 300 to form the drilling BHA 400 provides a fixed volume for the downhole hydraulic fluid, where:— the drilling tool 200, 300 is adapted to accommodate at least a portion of the said fixed volume of downhole hydraulic fluid at any given time; and the linear actuator/rotary assembly 100 is adapted to accommodate the remaining portion of the said fixed volume of downhole hydraulic fluid at said given time, and vice versa.

Additionally, as will be described subsequently in more detail, operation of the linear actuator/rotary assembly 100 rotates drive shaft 116 and which additionally pressurises the hydraulic fluid for supply to the drilling tool 200, 300 and moves more downhole hydraulic fluid from the chamber 137 of the linear actuator/rotary assembly 100 into the drilling tool 200, 300 and thus moves more of the portion of the said fixed volume of downhole hydraulic fluid at that given time from the linear actuator/rotary assembly 100 to the drilling tool 200, 300.

The drilling BHA 400 of FIGS. 24 and 25 comprises a PCM 1, electric motor 4 and planetary gear assembly 5 in a modular arrangement forming a drive assembly 10. The drive assembly 10 connects to a rotary assembly 100, which comprises a linear actuator in the form of a lead screw assembly arrangement, with a central drive shaft 116 that extends from an in use lowermost end (i.e. the right hand end as shown in FIG. 24) of the drive assembly 10 through the drilling BHA 400 to an in use uppermost end of drilling tool 200, 300 which comprises an anchor module 200 and a drilling module 300.

The rotary assembly 100 connects to the anchor module 200 which contains anchor members in the form of anchor pads 207 to stabilise the drilling tool 200, 300 against the wall of the casing or tubing etc. that is being drilled. The anchor module 200 then connects to the drill head module or drilling module 300, which contains the drilling member or dill bit 315 (which in this embodiment is a 12 mm spade drill insert but any other suitable drill bit 315 may be used) attached to the outer most end of a drill piston 314. The drilling member 315 performs the drilling of the hole through the sidewall of the tubular.

Each of these modules 200, 300 which together make up the embodiment of the drilling tool 200, 300 in accordance with the present invention are described in more detail as follows.

The gear assembly 5 connects to the in use lowermost end of the next drive shaft section 217 of the drilling tool 200, 300 via the drive shaft 116. An annular race of thrust bearings and washers 102, 105, 106 extends around the circumference of the drive coupling 103, the race of bearings and washers 102, 105, 106 being held in position by a split ring 104, which sits within a recess formed on the outer surface of the drive coupling 103.

The drive shaft 116 connects at its upper end to the drive coupling 103 and a portion of the drive shaft 116 is surrounded by a race of ball bearings 110, configured to facilitate rotation of the drive shaft 116.

The inner diameter of the top sub 101 narrows to create an axially-aligned bore through which the drive shaft 116 extends. Slightly spaced apart from the race of ball bearings 110 is an annular wedge seal 112U and a rod seal 119 which are respectively disposed within a pair of spaced apart recesses in the bore formed in the sub 101. The annular wedge seal 112U and the rod seal 119 seal against the outer diameter of the drive shaft 116 to resist fluid entry to the upper components of the drive coupling 103 (i.e. the ball bearings 110, thrust bearings 106 and so on). The inner diameter of the sub 101 then widens to create a pressure balance chamber 134.

An aperture 135 extends through the wall of the sub 111 and is configured to permit entry of well fluid into the pressure balance chamber 134 through a filter 118 to resist ingress of debris into the chamber 134. Within the pressure balance chamber 134 there is an annular balance piston 109 with a central bore through which the drive shaft 116 extends. The balance piston 109 has an annular inner seal, in this example a mandrel rod seal 120, which is disposed within a recess extending around the inner diameter of the bore of the balance piston 109 and seals against the outer surface of the drive shaft 116. The balance piston 109 further comprises an annular outer seal, in this example a cutter piston seal 121, which seals against the inner surface of the sub 101. The seals together act to resist fluid communication between the well and the upper end of the rotary assembly 100. The chamber 134 is thus pressure balanced with the pressure of hydrostatic fluid located in the wellbore outwith the drilling tool 200, 300.

The lower (in use) end of the sub 101 (the right hand end as shown in FIG. 10) is connected to the upper in use end of the lead screw assembly housing 115 by a threaded connection. The sub 101 is further locked to the lead screw assembly housing 115 by threaded fixings, in this example by screws 136 spaced apart around the circumference of the sub 101. The sub 101 is further locked to the lead screw assembly housing 115 by threaded fixings, in this example by screws 136 spaced apart around the circumference of the sub 101. The lower (in use) end of the lead screw assembly housing 115 (the right hand end as shown in FIG. 10) is connected to the upper in use end of a piston housing 108 by a threaded connection (which may be secured by suitable fixings). The lower (in use) end of the piston housing 108 (the right hand end as shown in FIG. 10) is connected to the upper in use end of an anchor head 201 of the anchor module 200 by a threaded connection (which may be secured by suitable fixings such as set screws 125).

The rotary assembly 100 further comprises a torque limiter 123 in the form of a clutch arrangement 123 to maintain a constant upper ceiling or limit of fluid pressure within the anchor module 200 and more particularly in the drilling module 300 and a preferred torque limiter 123 is a synchronous torque-limiting clutch (but this is not restrictive) such as an EAS®-Smartic® clutch available from Mayr®, Mauerstetten, Germany, but this is not limiting and not the only form of clutch 123 that would provide the required torque limitation function in the drilling BHA 400.

The torque limiter 123 is set to slip at a particular pre-determined value, for example 20-50 Nm, to achieve a suitable level of hydraulic pressure to be supplied from the rotary assembly 100 to the anchor module 200 and the drilling module 300 (e.g. 200-1500 psi or more preferably 800-1200 psi, but this can vary according to the drilling requirements and downhole environment) within the drilling module 300.

The drive shaft 116 passes through a central orifice in the torque limiter 123. The torque limiter 123 is clamped to the drive shaft 116 on the left hand side of the torque limiter 123 (the location of the side being in reference to the direction of illustration in the Figures, for example FIG. 10) and external circlip 127 prevents the torque limiter 123 from moving axially to the left beyond the circlip 127. The right hand side of the torque limiter 123 is connected to the left hand side (uphole) end of the lead screw 107 via a clutch plate 122 and screws 124 and thus rotation of the right hand side of the torque limiter 123 rotates the lead screw 107 which is screw threaded via external screw threads to the inner screw threads of a nut in the form of a main piston 113 (and thus axially drives the main piston 113 from the starting position in FIG. 10 and FIG. 24 towards the end position in FIG. 25).

A needle roller bearing 129 (with associated circlip 133) and an additional roller bearing 128 (and associated washer 130, internal circlip 131 and external circlip 132), are provided at the approximate midpoint of the drive shaft 116 and act between the lead screw assembly housing 115/piston housing 108 and the lead screw 107 in order to ensure that the drive shaft 116 is always centralised and thereby provide increased stability to the rotary assembly 100.

Accordingly, rotation of the drive shaft 116 results in rotation of the lead screw 107 (albeit said latter rotation is limited by the torque limiter 123) which results in axial movement of the main piston 113. The lower end of the main piston 113 is sealed against the inner bore of the piston housing 108 by lipseal 126 (when it is not located in recess 138) and the outer surface of the drive shaft 116 by wedge seal 112L. Thus, any axial movement of the main piston 113 from left to right as shown in FIG. 10 results in the lipseal 126 moving out of the recess 138 such that it seals against the (narrower) inner throughbore of the piston housing 108 which results in hydraulic fluid located in chamber 137 being pressurised (i.e. its pressure increases) due to the volume of the chamber 137 being decreased by said left to right movement of the main piston 113.

The increased pressure in the hydraulic fluid within chamber 137 is then transmitted to the anchor module 200 and the drilling module 300 such that, as the fluid increases in pressure within the chamber 137, the pressure correspondingly increases in the anchor module 200 and the drilling module 300, as will be further described subsequently.

The anchor pads 207 (along with the anchor pad 309 of the drilling module 300 as will be described subsequently) are thus deployed concurrently, and each of these anchor pads 207, 309 make contact with the inner surface of the tubular substantially simultaneously. The anchor module 200 is thus anchored prior to the drilling member 315 being actuated from the retracted configuration to the extended configuration which thereby ensures that the downhole BHA 400 is anchored prior to any drilling occurring and this has a significant safety and operational advantage. Continued increase in pressurisation of the hydraulic fluid will subsequently result in actuation of the drilling member 315 from the retracted configuration to the extended configuration as will be described in detail subsequently, such that drilling operations can then be carried out as detailed below.

The anchor module 200 forms part of the drilling tool in accordance with the present invention and is shown in FIGS. 11-15.

The drilling tool 200, 300 comprises a shear relief arrangement that allows for emergency venting of the tool should the tool fail. The shear relief arrangement comprises a spin collar 204 and a snap ring 205 provided at the uppermost end of the anchor module 200 along with a set of shear screws 125, where the snap ring 205 provides a shoulder that prevents the drilling tool 200, 300 from fully parting with the piston housing 108, because the spin collar 204 shoulders against the snap ring 205 if the screws 125 shear. The shear screws 125 are a form of frangible fasteners which pass through apertures in an end of the piston housing 108 and into the end of the anchor module head 201 and preferably partially extend into the wall of the anchor module head 201. In the event that the tool 200, 300 fails—for example it stalls, or it becomes trapped or jammed in the tubular—the BHA 400 can be jarred upwards (towards the surface). Jarring the BHA 400 breaks the shear screws 125 and the piston housing 108 can then move relative to the anchor module 200. The piston housing 108 moves partially axially away from the anchor module 200 while remaining connected to the anchor module 200 by means of the snap ring 205 and the spin collar 204 moving with the piston housing 108 in an uphole direction. The apertures through the piston housing 108 in which the shear pins 125 are disposed at least partially aligns with an annular seal around the end of the anchor module 200, unseating the annular seal from the groove in which it sits. This allows venting of the hydraulic fluid within the drilling tool 200, 300 into the wellbore. The drilling module 300 springs 322 bias the drilling member 315 to radially retract into the drilling module 300. Similarly, but subsequently thereto, the anchor pads 207, 309, radially retract into the anchor module 200 due to their respective springs 209, 210; 311, 312. The drilling tool 200, 300 and rest of the BHA 400 may then be recovered to surface.

Optionally, the tool comprises a shear relief arrangement that allows for emergency venting of the tool should the tool fail. Optionally the shear relief arrangement may be disposed at an end of the drilling tool and optionally between the connection of the anchor module and the rotary assembly. Optionally, the shear relief arrangement may comprise one or more frangible fasteners, optionally threaded fasteners such as shear screws.

The anchor module 200 further comprises an upper race of bearings 202B which sit within a ball bearing shield 202 which in turn sits within a recess formed in an end of the anchor module 200, with the race of bearings 202B being arranged to ease rotation of the drive shaft 116 at the point of entry to the anchor module 200. The anchor module 200 comprises a throughbore 200*b* through which the next section 217 of the drive shaft 116 extends. The ball bearing shield 202 is further held in position by a pair of internal circlips 203; 218 positioned within a respective groove adjacent to the bearings 202B at an upper end thereof, resisting movement of the race of bearings 202B and shield 202 towards the piston chamber 137. The anchor module 200 also comprises a lower race of bearings 213B which sit within a ball bearing shield 213 which in turn sits within a recess formed in a lower end of the anchor module 200, with the race of bearings 213B being arranged to ease rotation of the drive shaft 116 at the point of exit from the anchor module 200. The ball bearing shield 213 is further held in position by an internal circlip 214 positioned within a groove adjacent to the bearings 213B at a lower end, resisting movement of the race of bearings 213B and shield 213 towards the drilling module 300.

Figure 12:
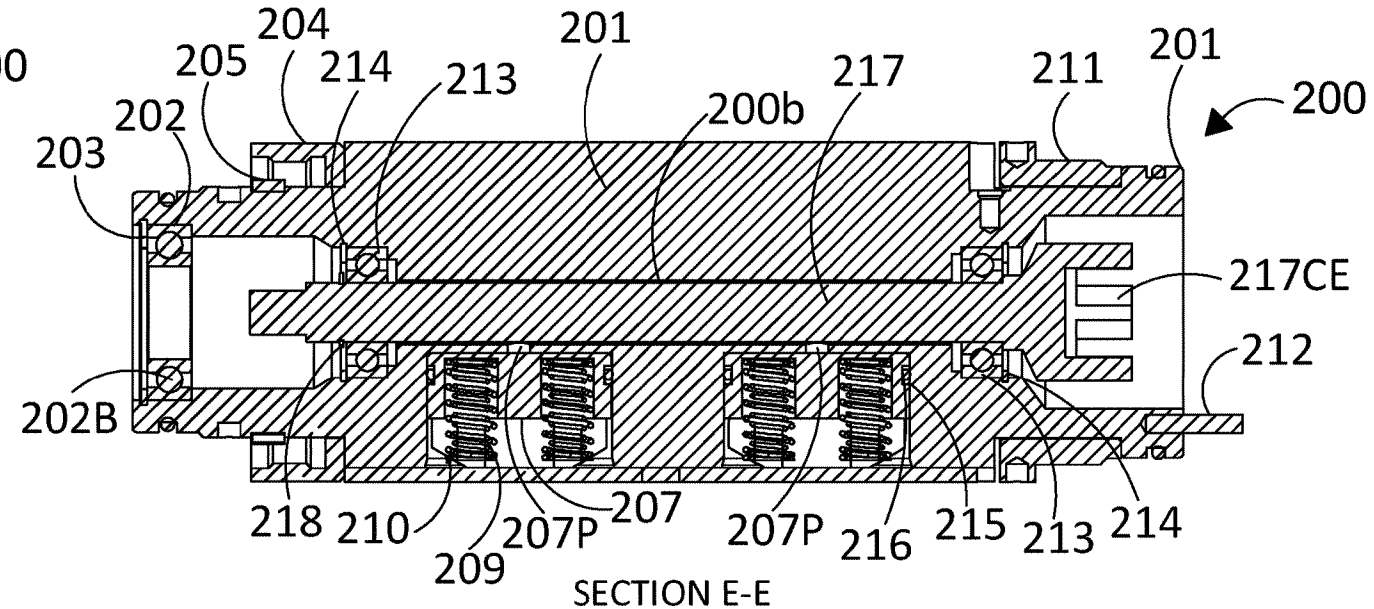
FIG. 12 shows a schematic cross sectional view through section E-E of the anchor module of FIG. 11, with the anchor members in the retracted (running in) position.
Figure 13:
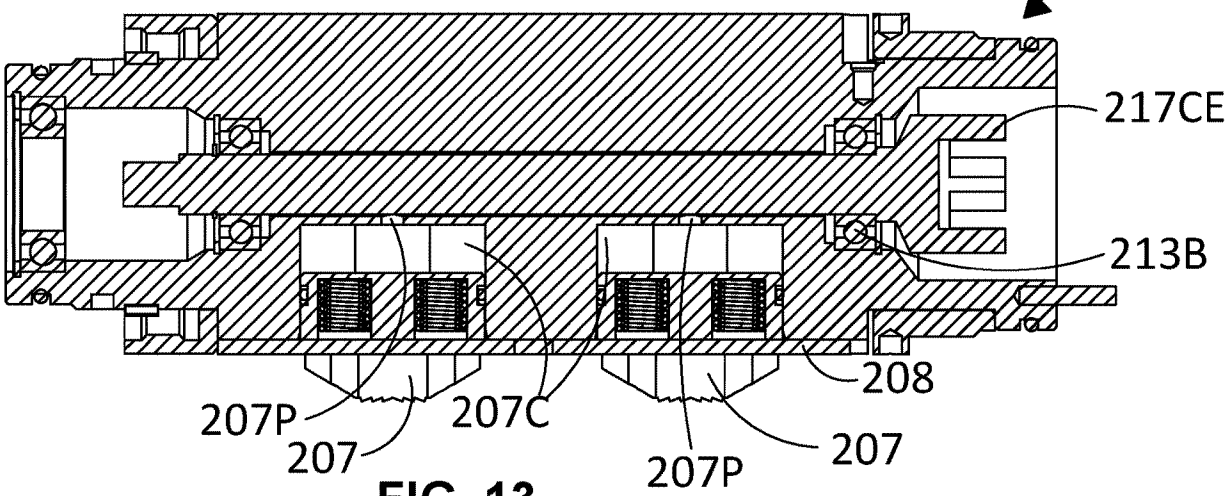
FIG. 13 shows a schematic cross sectional view through section E-E of the anchor module of FIG. 11, with the anchor members in the extended (anchoring) position.
Figure 14:
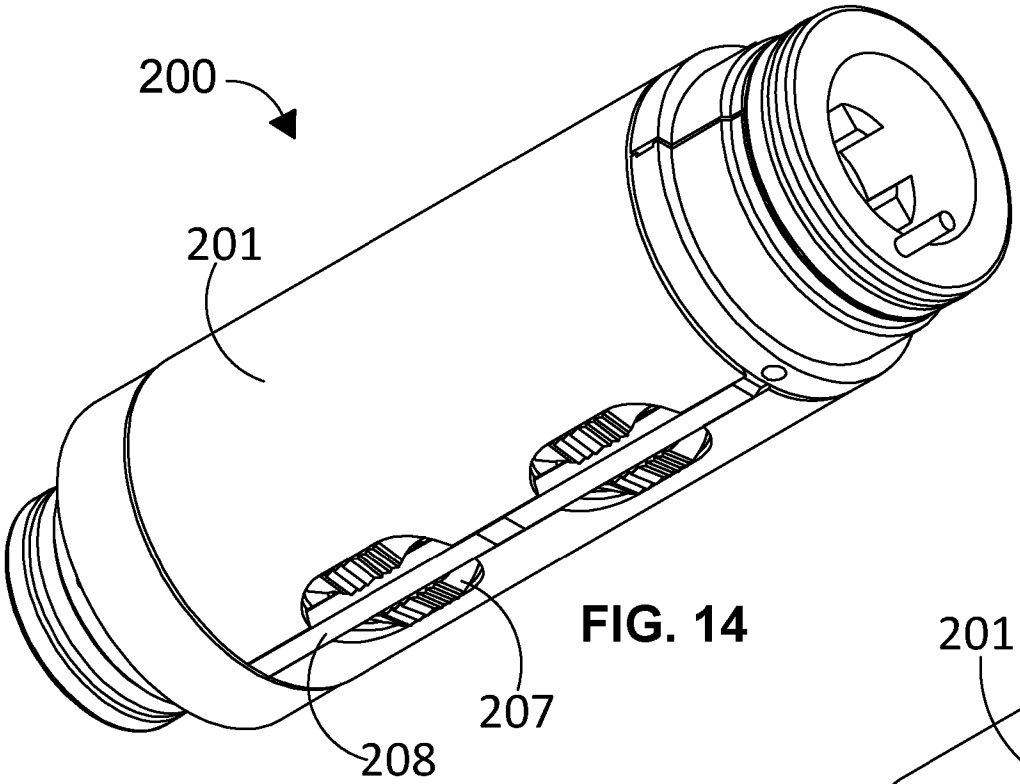
FIG. 14 shows a schematic perspective view of the (retracted) anchor module of FIG. 12.

The anchor module 200 comprises at least one (and as shown in FIGS. 12 and 13, the embodiment of anchor module 200 described herein comprises two) anchor members 207 in the form of anchor pads 207 that are operable to radially extend outwards to anchor the drilling tool 200, 300 against the inner wall of the tubular being cut. FIGS. 12, 14 and 24 show the anchor pads 207 in their retracted configuration. In this example, two anchor pads 207 are longitudinally aligned with each other on the same plane and are spaced apart along the longitudinal axis of the anchor module 200, with the pads 207 being diametrically opposite the drilling member 315, such that when the anchor pads 207 extend outwards and make contact with the inner throughbore of the formation or tubular (not shown), they not only anchor the drilling tool 200, 300 within the wellbore but they also push the anchor module 200 and the drilling module 300 towards the other side of the formation or tubular (i.e. the side of the drilling member 315), thus reducing the distance through which the drilling member 315 needs to be radially extended in order to make contact with the formation/tubular to be drilled. As seen in FIGS. 17 to 21, there is a further (third) anchor pad 309 provided in the drilling module 300 and which operates in exactly the same manner and at exactly the same time as the two anchor pads 207, where the further (third) anchor pad 309 is also longitudinally aligned and is therefore on the same longitudinal axis plane as the pair of anchor pads 207; the further (third) anchor pad 309 is arranged within the drilling module 300 such that it is (also) located on the other side of the drilling member 315 (i.e. it is located closer to the right hand or leading end of the drilling module 300 compared with the drilling member 315 whereas the said pair of anchor pads 207 are located further away from the leading end of the drilling module 300 compared with the drilling member 315). This arrangement ensures that the drilling member 315 is guaranteed to be moved closer to the tubular to be drilled in a uniform fashion and so that it will not attempt to cantilever the drilling module 300 away from the tubular once the drilling member 315 starts to extend.

As shown in FIGS. 12 to 15, the anchor pads 207 are held within cylindrical orifices formed through the sidewall of the anchor head 201 of the anchor module 200. The anchor pads 207 are each connected to anchor springs 209, 210, that act between the inner surface of the retainer bar and an outwardly directed surface of the anchor pads 207 and are therefore resiliently biased against radially outwards movement of the anchor pads 207 from their retracted configuration. The anchor springs 209, 210 particularly facilitate retraction of the anchor pads 207 in shallow working conditions and/or conditions with low hydrostatic pressure.

The anchor pads 207 are restrained from falling out of the anchor module 200 by retainer bar 208. Each anchor pad 207 has an axially-aligned groove on its outer surface into which the retainer bar 208 can fit. The width of the bar 208 and the depth of the grooves on the anchor pads 207 are selected so that when the anchor pads 207 extend radially outward from the anchor module 200, the pads 207 can travel a sufficient distance to make contact with the inner wall of the tubular to anchor the drilling tool 200, 300. The surface of the anchor pads 207 is further textured with ridges or similar to enhance the frictional contact with the surface of the object being drilled and reduce the chance of undesirable movement (rotational or axial) of the drilling tool 200, 300 as it is operational. The further (third) anchor pad 309 provided in the drilling module 300 is arranged within its respective cylindrical orifice, is biased by springs 311, 312 and is retained by a retainer bar 310 provided in the drilling module 300 all in exactly the same way and for the same purpose as the anchor pads 207.

When the fluid pressure within the piston chamber 137 is relatively low, the anchor springs 209, 210 (and springs 311, 312) act to hold the anchor pads 207 (and the respective anchor pad 309) within the body of the anchor module 200 (and the respective drilling module 300 for the third anchor pad 309) in their retracted positon spaced apart from the tubular to be drilled. As the fluid pressure builds up within the piston chamber 137, due to the fluid communication between the chamber 137 and the throughbore **200*b* of the anchor module 200 (and a fluid conduit 330 formed through the drilling module 300), pressurised fluid in turn builds up within fluid ports 207P (formed through a portion of the sidewall leading from the throughbore 200*b* of the anchor module 200), which respectively direct fluid towards the rear inner face of the anchor pads 207, 309. Each anchor pad 207, 309 has a pair of annular seals 215, 216, 323, 324 disposed within an annular recess in the outer surface of the side of the anchor pads 207, 309 which seals against the inner surface of the orifice in which the anchor pads 207, 309 sit and resists fluid ingress or egress between the wellbore and the fluid ports 207P, throughbore 200*b* or fluid conduit 330. The hydraulic fluid pressure behind the anchor pads 207, 309 continues to increase as the main piston 113 moves downward (from left to right as shown in the movement which occurred in between FIGS. 24 and 25**).

Figure 15:
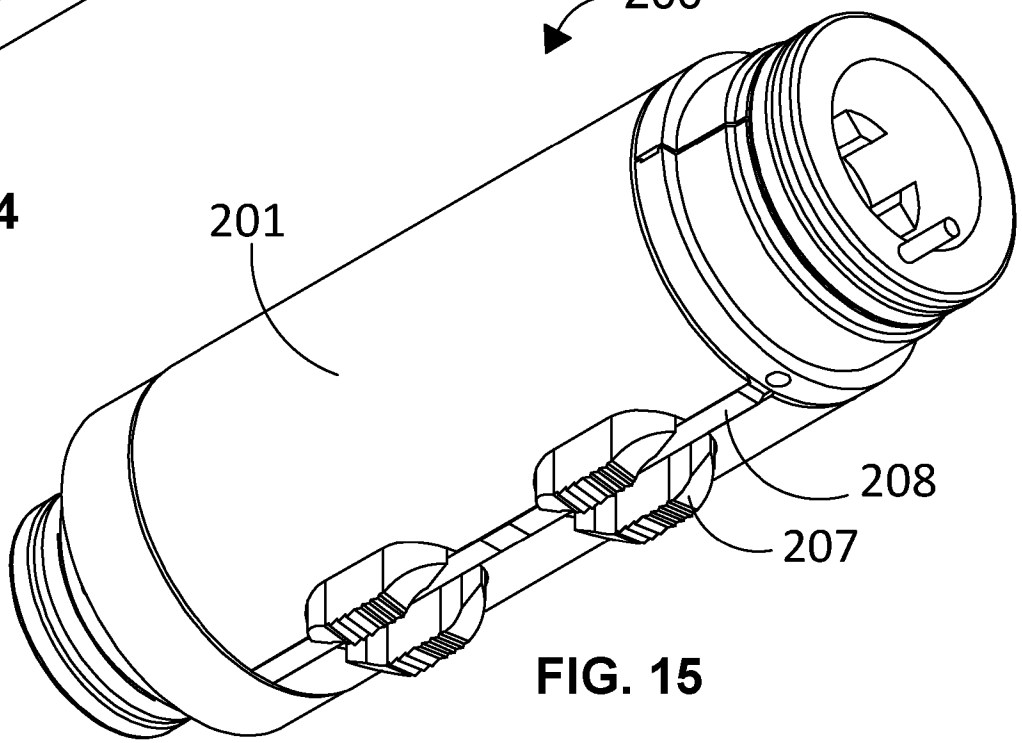
FIG. 15 shows a schematic perspective view of the (extended) anchor module of FIG. 13.
Figure 21:
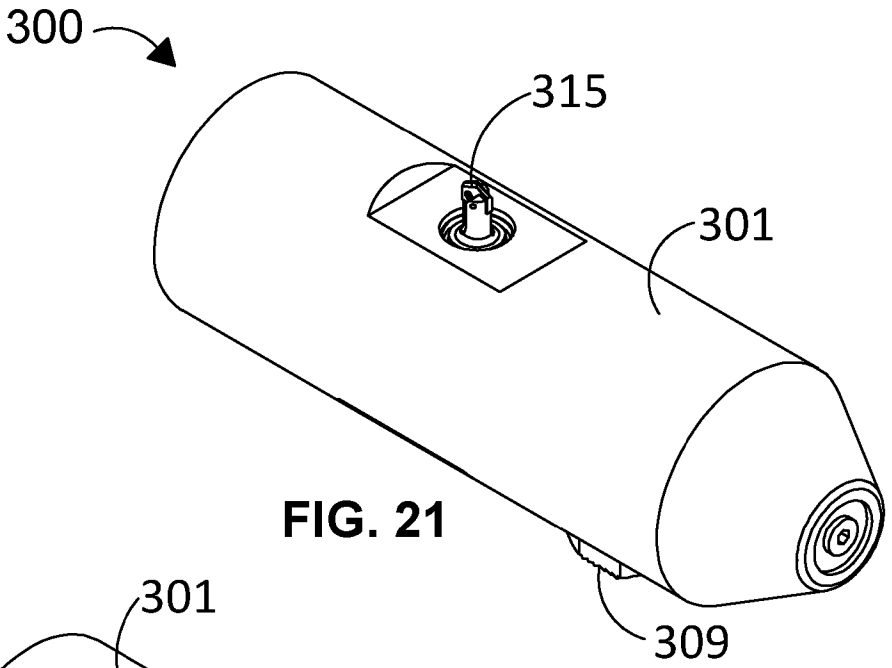
FIG. 21 shows a schematic perspective view of the (extended) drilling module of FIG. 18.
Figure 20:
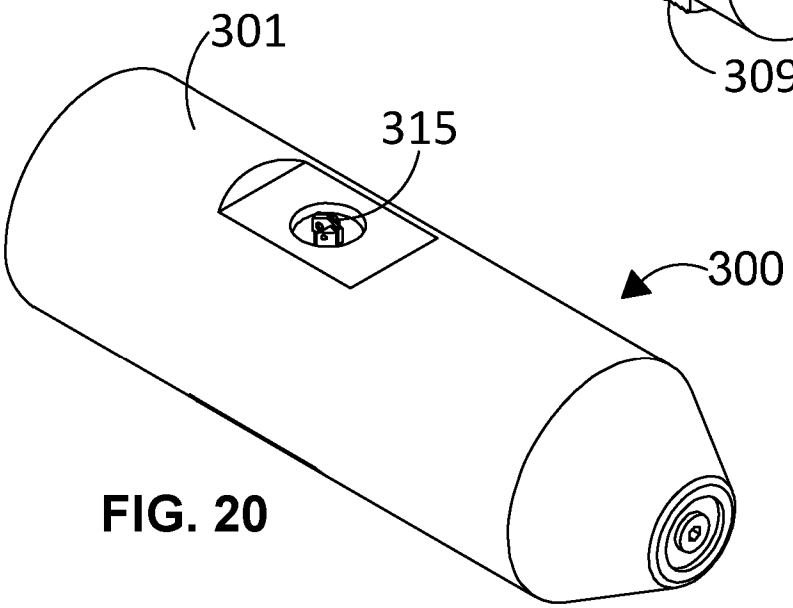
FIG. 20 shows a schematic perspective view of the (retracted) drilling module of FIG. 17.
Figure 19:
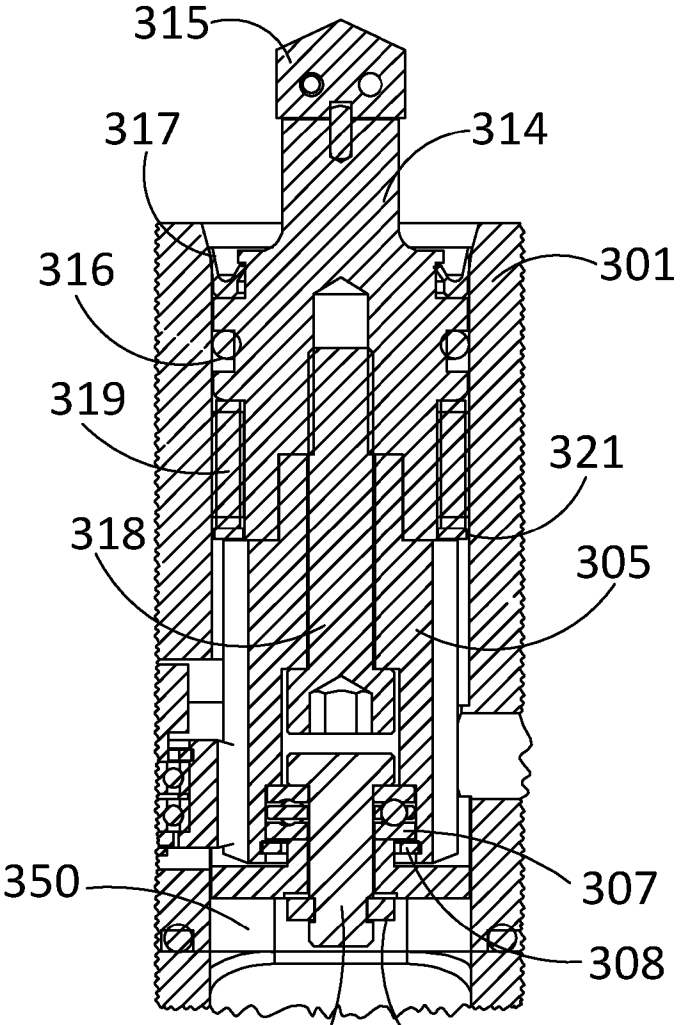
FIG. 19 shows a schematic cross sectional detailed view of the drilling member (within its housing) of the drilling module of FIG. 18, with the drilling member in the extended (drilling) position.

After a period of time (which can be relatively short), the fluid pressure within the fluid ports 207P and fluid conduit 330 reaches a sufficiently high level to overcome the biasing force of the anchor springs 209, 210 (and 311, 312) (for example, 10-500 psi) and pushes against the rear inner face of the anchor pads 207, 309, creating a hydraulic fluid chamber 207C, 309C which starts to increase in volume and in-so-doing radially extends the anchor pads 207, 309 until they make contact with the inner surface of the tubular to be drilled. The drilling tool 200, 300 is thus anchored by the anchor pads 207, 309 against one side of the tubular (the side opposite that to be drilled through). FIGS. 13 and 15 illustrate the anchor module 200 in a "deployed" configuration with the anchor pads 207 having been moved outwards in response to fluid pressure i.e. the anchor pads 207 being radially extended from the body of the anchor module 200. FIGS. 13, 18 and 21 illustrate the drilling module 300 in a "deployed" configuration with the anchor pad 309 having been moved outwards in response to fluid pressure i.e. the anchor pad 309 being radially extended from the body of the drilling module 300.

Importantly, the anchor pads 207, 309 deploy first before there is any movement of the drilling member 315 and this is achieved by at least one of and preferably both of:— i) the respective springs of the anchor pads 207, 309 being weaker (i.e. having a lower spring force) than the springs 322 used around the drilling member 315; and ii) the surface area of the rear inner face of the anchor pads 207, 309 (and more specifically the surface area of the anchor seals 215, 216; 323, 324) being greater than the surface area of the rear inner face of the drill piston 314 secured to the inner end of the drilling member 315 (and more specifically the surface area of the o-ring seal 316 which surrounds the drill piston 314) and thus the same fluid pressure (due to it being the same hydraulic fluid supply) acting on the resulting respective piston area creates more moving force acting upon the anchor pads 207, 309 compared with the moving force acting upon the drilling member 315.

As indicated above and illustrated in FIGS. 24 and 25, the drilling module 300 is connected at an in use uppermost end to the in use lower most end of the anchor head 201 of the anchor module 200 with a dowel 212 projecting from the lower most end of the anchor head 201 into a dowel recess (not shown) provided in the uppermost end of the drill head 301 of the drilling module 300, where the dowel ensures that no relative rotation can occur between the drill head 301 and the anchor head 201, and thus ensures that the drill head 301 and the anchor head 201 are secured to one another. A split retainer 211 is also provided around the in use lowermost end of the anchor head 201 and allows the anchor module 200 and drill module 300 to be threaded together without relative rotation to one another. This allows the dowel 212 to engage the mating hole during make up to keep the modules 200, 300 aligned so that the anchor pads are 180 degrees apart from the drilling member 315.

At the upper end of the drilling module 300, there is a gearing assembly 333 having at its in use upper most end a bevel gear with a castellated upper end 337. The lower end of the portion 217 of the drive shaft 116 has a corresponding castellated lower end 217 CE that is inserted into the castellated upper end 337 for mutual engagement of the drive shaft 116, 217 and the bevel gear 335 (and the rest of the gearing assembly 333). Due to the castellated connection, the rotation of the drive shaft 116, 217 drives rotation of the gearing assembly 333 and which in turn drives rotation of the drilling member 315 as will be subsequently described.

The gearing assembly 333 further comprises a perpendicular bevel gear 302 which meshes with the bevel gear 335 at 90 degrees thereto such that the rotation of the drive shaft 116, 217 about its longitudinal axis is transformed into rotation of the perpendicular bevel gear 302 about its longitudinal axis which is of course perpendicularly arranged when compared to the longitudinal axis of the bevel gear 335. A smaller diameter driven gear 340 is connected to the perpendicular bevel gear 302 via a connecting rod 342, there the driven gear 340 meshes with and therefore drives an idle spur gear 345 which in turn meshes with and therefore drives a drill piston spur gear 305.

The drilling member 315 is securely mounted upon a drill piston 314 which in turn is securely mounted upon the drill piston spur gear 305 by means of a screw 318 (and thus the drilling member can be considered to be the combined components of the drilling member 315, the drill piston 314 and the drill piston spur gear 305 particularly if those three components were formed integrally in one piece). A needle roller bearing 319 or the like is provided around the outer circumference of the drill piston 314 (and is secured in pace by a piston spacer 321) to enable rotation of the drill piston 314 with respect to the throughbore walls of the cavity formed in the drill head 301 within which the drilling member 315 is located. Thus, any rotation of the drive shaft 116, 217 in a first direction results in rotation of the drill piston spur gear 305 (and thus the drill piston 314 and the drilling member 315) in a first direction and any rotation of the drive shaft 116, 217 in a reverse direction also results in reverse rotation of the drill piston spur gear 305 (and thus the drill piston 314 and the drilling member 315).

In addition, innermost end of the drill piston spur gear 305 is secured to (although it can rotate relative thereto by means of a thrust bearing 307) a spring bar 304 by a spring bar bolt 306, circlip 308 and C-washer 320 arrangement, where the radially outwardly directed surface of the spring bar 304 is further connected to or are compressed against a first (innermost) end of at least one and preferably a plurality of relatively strong springs 322 (and/or there are preferably more springs 322 around the drilling member 315 than the number of springs 209, 210, 311, 312 provided for the anchor members 207; 309). The other (outermost) ends of the springs 322 are compressed against an inwardly directed surface of the drill head 301 and therefore resiliently biased against radially outwards movement of the drilling member 315 from its retracted configuration.

Accordingly, the drill module 300 is arranged such that any radially outwards movement of the drill piston 314 and thus the drill piston spur gear 305 also forces the spring bar 304 to move radially outwards thus causing the springs 322 to compress, thereby storing spring force therein. A flange plate 303 is provided over the innermost end of the cavity/chamber 350 in which the innermost end of the drill piston 314 and thus the drill piston spur gear 305 are located. The flange plate 303 is sealed to the drill head 301 by seal 325 but can be removed if required by the operator to provide access to the inner end of the drill piston 314 and thus the drill piston spur gear 305.

The fluid conduit 330 is in fluid communication with the fluid chamber 137 via the throughbore 200*b* of the anchor module 200, around the gearing assembly 333 and beneath the seal 316 which surrounds the drill piston 314.

Thus, the hydraulic fluid in the area below (internal of) the seal 316 acts upon the seal and thus the drill piston 314 and therefore if the pressure of said hydraulic fluid is greater than the pressure of the wellbore fluid, the greater pressure of the hydraulic fluid will act to force the drill piston 314 and thus the drilling member 315 outwards (assuming the force acting on the seal 316 is greater than the oppositely directed spring force provided by the springs 322). The drill piston 314 is provided with a cup shaped scraper 317 around its outermost end and which is arranged to scrape away any debris or swarf as the drill piston moves radially outwardly.

The drilling module is provided with an end plug 313 which can be removed at the surface during make up or redressing of the drilling tool 200, 300 in order to permit filling of the conduit 330 and the rest of the hydraulic fluid volume including the fluid chamber 137, where the plug will be fitted again once the hydraulic fluid volume is filled.

The run-in-hole configuration of the drilling module 300 is shown in FIGS. 17, 20, 24, 26 and 29. Fluid pressure passing from the chamber 137 enters into the upper end of the drilling module 300 and further enters into fluid conduit 330. Fluid/fluid pressure passing into the drilling module 300 builds up behind the anchor pad 309 and once the pressure is great enough to overcome the oppositely directed spring force of the springs 311, 312, the anchor pad 309 extends radially outwards from the drilling module 300 as shown in FIGS. 18, 21 and 25 until the anchor pad 309 makes contact with the inner wall of the tubular; this occurs simultaneously with the anchor pads 207 because all three of the anchor pads 207, 309 have the same spring force acting upon them and the same seal surface area and the same fluid pressure acting upon said respective seal area. This also balances the anchoring action of the anchor pads 207, 309 and therefore balances the drilling action of the drilling member 315 as it (subsequently) drills into the tubular, helping to keep the drilling module 300 stable. This in turn means that the drilled hole made in the tubular stays on the same longitudinal axis through the sidewall of the tubular, thereby providing a cleaner hole therein, thereby reducing the time taken for the hole to be drilled and reducing the risk of damage to the drilling member 315.

The drill piston 314 sits within a recess formed in the drill head 301. Similarly to anchor pads 207, 309, fluid is conducted through the drilling module 300, through the gearing assembly 333 (and latterly into the conduit 330) and builds up behind the seal 316 of the drill piston 314 in a chamber 350 that increases in volume as the drill piston 314 moves radially outwards. As the fluid pressure increases, the drilling member 315 is pushed out of the drilling module 300 and extends radially outwards (as shown in FIGS. 18, 21 and 25), making contact with the inner wall of the tubular to perform the drilling action. As can be best seen in FIGS. 29 and 30, the drill piston spur gear 305 is considerably longer than the width of the idle spur gear 345 in order to accommodate the full range of radial movement that the drill piston spur gear 305 will experience, thus ensuring that the drill piston spur gear 305 remains in constant mesh contact with the idle spur gear 345 no matter if it is in the retracted position (FIG. 29) or the extended position (FIG. 30).

As rotational load is applied to the drilling member 315, it drills through the sidewall of the tubular and the load applied to the drilling member 315 is kept substantially constant by the torque limiter 123, allowing the drilling member 315 to most efficiently drill into the tubular, thereby saving the power output from the battery pack of the PCM 1.

The radially outwards directed load applied to the drilling member 315 is thus provided by the fluid pressure within the piston chamber 137 increasing and this increase being transmitted through the anchor module 200 into the drilling module 300. Should the fluid pressure exceed a predetermined threshold (for example 200-1500 psi and more preferably 800-1200 psi, but this may vary according to the drilling requirements and downhole environment) the torque limiter 123 will also act and will therefore prevent the pressure from increasing above a pre-determined level such that the hydraulic main piston 113 remains in place or backs off (i.e. halts or moves in the reverse direction from right to left as shown in FIG. 10 thereby stabilising or increasing the volume of the chamber 137) and the fluid pressure therefore stabilises or decreases below the threshold. Maintaining the fluid pressure within the piston chamber 137 at a substantially constant level mitigates the risk of damage to the drilling member 315 from too much load being applied during drilling, while maintaining a constant force on the drilling member 315 in order to drill a hole through the sidewall of the tubular.

The running time of the drilling tool 200, 300 can be pre-set in the PCM 1 to a length of time that is sufficient to ensure drilling is complete. When drilling is completed, rotation of the drive shaft 116 is reversed. This in turn pulls the lead screw 107 and the main piston 113 back towards the original configuration. In order to ensure that the drilling member 315 is completely retracted, the hydraulic main piston 113 is retracted back to the main piston's 113 original start point within the rotary assembly 100, until the main piston 113 aligns with the recess 138 in the lead screw assembly housing 115. The spring return mechanism provided by the springs 322 of the drilling member 315 and the springs 209, 210 (and 311, 312) of the anchor pads 207 (and 309) ensure retraction of firstly the drilling member 315 and subsequently the respective anchor pads 207, 309; this may be particularly useful in, for example, shallow drilling operations where there is little to no hydrostatic pressure to assist with the return of the drilling member 315 and/or the anchor pads 207, 309. This permits the drilling tool 200, 300 to be used again and again (as permitted by the amount of remaining power in the battery pack of the PCM 1).

The drilling BHA 400 can be moved in the wellbore to the next position at which a hole is desired to be drilled through the sidewall of the tubular or the formation. Alternatively, or in addition, the drilling BHA 400 can be provided with an indexer tool (not shown) to permit the drilling tool 200, 300 to be rotated (in addition to moving it up and down the well) prior to actuating the anchor pads 207, 309 and then actuating the drilling member 315.

Once the drilling tool 200, 300 has been used to drill the desired number of holes in the sidewall of the tubular or formation, the drilling BHA 400 can be withdrawn from the wellbore back to the surface.

Modifications and improvements may be made to the examples and embodiments hereinbefore described without departing from the scope of the invention.

The invention claimed is:

1. A Bottom Hole Assembly (BHA) for use in a well, the BHA comprising: a motive assembly having a downhole torque generator which comprises a rotatable shaft; the BHA further comprising:

a fixed volume of downhole hydraulic fluid contained therein, defining a downhole hydraulic fluid supply;

a drilling tool coupled to the rotatable shaft, the drilling tool being adapted to connect to said downhole hydraulic fluid supply, the drilling tool having a longitudinal axis; the drilling tool comprising:

at least one anchoring member having an inner face contactable by hydraulic fluid from said downhole hydraulic fluid supply and being moveable radially, by means of pressurised hydraulic fluid from said downhole hydraulic fluid supply acting upon said inner face, with respect to the longitudinal axis of the drilling tool, between:— a retracted position in which the at least one anchoring member is spaced apart from an inner surface of the well; and an extended position in which the anchoring member contacts an inner surface of the well; and a drilling member having a longitudinal axis and having an inner face contactable by hydraulic fluid from said downhole hydraulic fluid supply, the drilling member being rotatable in use about said longitudinal axis, wherein the drilling member is arranged within the drilling tool such that the longitudinal axis of said drilling member is substantially perpendicular to said longitudinal axis of said drilling tool; and wherein said drilling member is also moveable radially, by means of pressurised downhole hydraulic fluid from said downhole hydraulic fluid supply acting upon said inner face thereof, with respect to the longitudinal axis of the drilling tool between:— a retracted position in which the drilling member is spaced apart from an inner surface of the well; and an extended position in which the drilling member contacts an inner surface of the well;

wherein the inner face of the anchoring member is in fluid communication via said hydraulic fluid with the inner face of the drilling member such that both respective inner faces experience the same pressure of the said hydraulic fluid acting upon them;

wherein the drilling tool further comprises a movement mechanism for rotating the drilling member about the longitudinal axis of the drilling member;

wherein the drilling tool is further adapted to also connect to the downhole torque generator and wherein at least a portion of the said movement mechanism of the drilling tool is coupled to the rotatable shaft which provides rotational movement;

wherein operation of the motive assembly is configured to rotate the rotatable shaft and rotate at least a portion of the movement mechanism of the drilling tool; and wherein the operation of the motive assembly is configured to pressurise said fixed volume downhole hydraulic fluid for supply to the drilling tool.

2. A Bottom Hole Assembly (BHA) according to claim 1, wherein the drilling tool is arranged such that the at least one anchoring member is arranged to move radially outwards before (i.e. prior to) the drilling member being moved radially outwards.

3. A Bottom Hole Assembly (BHA) according to claim 1, wherein the drilling tool is arranged such that the at least one anchoring member is arranged to move radially inwards after the drilling member has been moved radially inwards.

4. A Bottom Hole Assembly (BHA) according to claim 1, wherein the drilling tool comprises a biasing arrangement which ensures that the at least one anchoring member is moved radially outwards prior to the drilling member being moved radially outwards, and wherein the biasing arrangement is arranged such that the drilling member is moved radially inwards prior to the at least one anchoring member being moved radially inwards.

5. A Bottom Hole Assembly (BHA) according to claim 4, wherein the biasing arrangement comprises at least one of:— i) one or more biasing devices which act to bias at least one of and preferably both of the said at least one anchoring member and the drilling member radially inwards; and ii) the relative cross sectional area of the respective inner faces of the said at least one anchoring member and the drilling member.

6. A Bottom Hole Assembly (BHA) according to claim 5, wherein the biasing device of the drilling member comprises springs, and wherein the springs of the drilling member are arranged such that their longitudinal axis is offset from or is not co-axial with the longitudinal axis of the drilling member, such that a plurality of springs can be arranged around the circumference of the drilling member.

7. A Bottom Hole Assembly (BHA) according to claim 4, wherein the biasing arrangement is arranged such that a greater resultant inwardly directed force acts upon the drilling member compared with the at least one anchoring member.

8. A Bottom Hole Assembly (BHA) according to claim 1, wherein the cross sectional area of the inner face of the at least one anchoring member is higher than the cross sectional area of the inner face of the drilling member.

9. A Bottom Hole Assembly (BHA) according to claim 1, wherein the movement mechanism comprises a rotational translation movement mechanism arranged to translate rotational movement of a shaft rotatable in use about a longitudinal axis coincident and/or parallel with said longitudinal axis of the drilling tool into rotational movement of the drilling member about its longitudinal axis.

10. A Bottom Hole Assembly (BHA) according to claim 9, wherein the rotational translation movement mechanism comprises a geared movement mechanism which translates the direction of rotation substantially through 90 degrees.

11. A Bottom Hole Assembly (BHA) according to claim 1, wherein the drilling tool is adapted to accommodate at least a portion of the said fixed volume of downhole hydraulic fluid at any given time; and wherein the motive assembly is adapted to accommodate the remaining portion of the said fixed volume of downhole hydraulic fluid at said given time, and vice versa.

12. A Bottom Hole Assembly (BHA) according to claim 11, wherein operation of the motive assembly rotates the rotatable shaft and which additionally pressurises the hydraulic fluid for supply to the drilling tool and moves more downhole hydraulic fluid from the motive assembly into the drilling tool and thus moves more of the portion of the said fixed volume of downhole hydraulic fluid at that given time from motive assembly to the drilling tool.

13. A Bottom Hole Assembly (BHA) according to claim 1, wherein the retracted position of the drilling member results in the drilling member being closer to the longitudinal axis of the drilling tool (compared with the extended position), and wherein the extended position of the drilling member results in the drilling member being further away from the longitudinal axis of the drilling tool (compared with the retracted position).

14. A Bottom Hole Assembly (BHA) according to claim 1, wherein the drilling member is operable to drill a port through a sidewall of a downhole tubular string previously run into the well.

15. A Bottom Hole Assembly (BHA) according to claim 1, wherein the motive assembly comprises a battery pack and a motor.

16. A Bottom Hole Assembly (BHA) according to claim 15, wherein the tool further comprises a rotary assembly operatively coupled to the motive assembly, wherein the rotary assembly comprises a piston, and wherein the motor is configured to be selectively operated in reverse rotation which reverses rotation of the rotatable shaft and reduces fluid pressure within the tool due to retraction of the piston.

17. A Bottom Hole Assembly (BHA) according to claim 1, wherein when the drilling operation is completed and the drilling tool is to be retrieved from the well, firstly the drilling members can be retracted and subsequently thereafter the anchoring members can be retracted.

18. A Bottom Hole Assembly (BHA) according to claim 17, wherein the motive assembly comprises a battery pack and a motor; and wherein current being provided to the tool by the battery pack can be monitored during the drilling operation.

19. A Bottom Hole Assembly (BHA) according to claim 1, wherein the BHA further comprises a rotary assembly, said rotary assembly comprising a linear actuator, and wherein the linear actuator comprises a lead screw and a lead screw nut.

20. A Bottom Hole Assembly (BHA) according to claim 19, wherein the lead screw nut comprises a throughbore, and wherein the lead screw nut surrounds at least a portion of the lead screw such that at least a portion of the lead screw is located within the throughbore.

21. A Bottom Hole Assembly (BHA) according to claim 19, wherein the rotary assembly further comprises a piston, wherein the lead screw nut is coupled to the piston, and wherein the lead screw nut and piston are connected together by screws or other fixings.

22. A Bottom Hole Assembly (BHA) according to claim 21, wherein a piston chamber is located within the rotary assembly between the piston and the drilling tool, and wherein the piston chamber comprises a fluid that is to be compressed by the piston.

23. A method for drilling through a sidewall in a tubular in a well, the method comprising:

deploying a Bottom Hole Assembly (BHA) into the well to the depth at which the sidewall of the tubular is to be drilled, the BHA comprising:

a motive assembly having a downhole torque generator which comprises a rotatable shaft;

the BHA further comprising a fixed volume of downhole hydraulic fluid contained therein, defining a downhole hydraulic fluid supply; and a drilling tool coupled to the rotatable shaft, the drilling tool being adapted to connect to said downhole hydraulic fluid supply, wherein the drilling tool comprises:

one or more anchoring members having an inner face contactable by hydraulic fluid from said downhole hydraulic fluid supply:

a drilling member having a longitudinal axis and having an inner face contactable by hydraulic fluid from said downhole hydraulic fluid supply, wherein the inner face of the anchoring member is in fluid communication via said hydraulic fluid with the inner face of the drilling member such that both respective inner faces experience the same pressure of the said hydraulic fluid acting upon them; and a movement mechanism for rotating the drilling member about its longitudinal axis, wherein the drilling tool is further adapted to also connect to the downhole torque generator and wherein at least a portion of the said movement mechanism of the drilling tool is coupled to the rotatable shaft which provides said rotational movement:

the method further comprising:

operating the downhole torque generator of the motive assembly to rotate the rotatable shaft to rotate at least a portion of the movement mechanism of the drilling tool, and thereby rotating the drilling member around an axis perpendicular to the longitudinal axis of the drilling tool;

operating the downhole torque generator of the motive assembly to additionally pressurise said hydraulic fluid for supply to the drilling tool;

applying fluid pressure from said downhole hydraulic fluid supply to the inner face of the one or more anchoring members to firstly move the one or more anchoring members radially into contact with an inner surface of the well in response to modification of the fluid pressure; and applying fluid pressure from said downhole hydraulic fluid supply to the inner face of the drilling member to secondly move the drilling member radially in response to modification of the fluid pressure.

24. A method for drilling through a sidewall in a tubular in a well according to claim 23, wherein the method further comprises:

reducing fluid pressure to the inner face of the drilling member to firstly move said drilling member into a retracted position in which the drilling member is spaced apart from an inner surface of the well; and reducing fluid pressure to the inner face of one or more anchoring members to secondly move said one or more anchoring members into a retracted position in which the at least one anchoring member is spaced apart from an inner surface of the well.

25. A method for drilling through a sidewall in a tubular in a well according to claim 24, wherein the method further comprises:

reversing the direction of rotation of the rotatable shaft to reduce fluid pressure within the tool to firstly move said drilling member and secondly move said one or more anchoring members into said respective retracted positions.

26. A method for drilling through a sidewall in a tubular in a well according to claim 23, wherein the method further comprises:

providing the drilling tool with a battery pack and a motor; and monitoring the current being provided to the motor by said battery pack during the drilling operation.

27. A drilling tool for use in a well, the drilling tool being adapted to connect to a downhole hydraulic fluid supply, the drilling tool having a longitudinal axis; the drilling tool comprising:

at least one anchoring member having an inner face contactable by hydraulic fluid from said downhole hydraulic fluid supply and being moveable radially, by means of pressurised hydraulic fluid from said downhole hydraulic fluid supply acting upon said inner face, with respect to the longitudinal axis of the drilling tool, between:— a retracted position in which the at least one anchoring member is spaced apart from an inner surface of the well; and an extended position in which the anchoring member contacts an inner surface of the well; and a drilling member having a longitudinal axis and having an inner face contactable by hydraulic fluid from said downhole hydraulic fluid supply, the drilling member being rotatable in use about said longitudinal axis, wherein the drilling member is arranged within the drilling tool such that the longitudinal axis of said drilling member is substantially perpendicular to said longitudinal axis of said drilling tool; and wherein said drilling member is also moveable radially, by means of pressurised downhole hydraulic fluid from said downhole hydraulic fluid supply acting upon said inner face thereof, with respect to the longitudinal axis of the drilling tool between:— a retracted position in which the drilling member is spaced apart from an inner surface of the well; and an extended position in which the drilling member contacts an inner surface of the well;

wherein the inner face of the anchoring member is in fluid communication via said hydraulic fluid with the inner face of the drilling member such that both respective inner faces experience the same pressure of the said hydraulic fluid acting upon them;

wherein the drilling tool further comprises a movement mechanism for rotating the drilling member about its longitudinal axis;

wherein the movement mechanism comprises a rotational translation movement mechanism arranged to translate rotational movement of a shaft rotatable in use about a longitudinal axis coincident and/or parallel with said longitudinal axis of the drilling tool into rotational movement of the drilling member about its longitudinal axis;

wherein the drilling tool is further adapted to also connect to a downhole torque generator which comprises a rotatable shaft and wherein at least a portion of the said movement mechanism of the drilling tool is coupled to the rotatable shaft which provides said rotational movement;

wherein the drilling tool is coupled to a motive assembly having said rotatable shaft, wherein operation of the motive assembly is configured to rotate the rotatable shaft and rotate said at least a portion of the movement mechanism of the drilling tool;

wherein the operation of the motive assembly is configured to rotate the rotatable shaft and pressurise hydraulic fluid for supply to the drilling tool;

wherein the drilling tool and the motive assembly when coupled together form a bottom hole assembly which is adapted to provide a fixed volume for the downhole hydraulic fluid, where:— the drilling tool is adapted to accommodate at least a portion of the said fixed volume of downhole hydraulic fluid at any given time; and the motive assembly is adapted to accommodate the remaining portion of the said fixed volume of downhole hydraulic fluid at said given time, and vice versa.

28. A drilling tool according to claim 27, wherein operation of the motive assembly rotates the rotatable shaft and which additionally pressurises the hydraulic fluid for supply to the drilling tool and moves more downhole hydraulic fluid from the motive assembly into the drilling tool and thus moves more of the portion of the said fixed volume of downhole hydraulic fluid at that given time from motive assembly to the drilling tool.

29. A drilling tool for use in a well, the drilling tool being adapted to connect to a downhole hydraulic fluid supply, the drilling tool having a longitudinal axis; the drilling tool comprising:

at least one anchoring member having an inner face contactable by hydraulic fluid from said downhole hydraulic fluid supply and being moveable radially, by means of pressurised hydraulic fluid from said downhole hydraulic fluid supply acting upon said inner face, with respect to the longitudinal axis of the drilling tool, between:— a retracted position in which the at least one anchoring member is spaced apart from an inner surface of the well; and an extended position in which the anchoring member contacts an inner surface of the well; and a drilling member having a longitudinal axis and having an inner face contactable by hydraulic fluid from said downhole hydraulic fluid supply, the drilling member being rotatable in use about said longitudinal axis, wherein the drilling member is arranged within the drilling tool such that the longitudinal axis of said drilling member is substantially perpendicular to said longitudinal axis of said drilling tool; and wherein said drilling member is also moveable radially, by means of pressurised downhole hydraulic fluid from said downhole hydraulic fluid supply acting upon said inner face thereof, with respect to the longitudinal axis of the drilling tool between:— a retracted position in which the drilling member is spaced apart from an inner surface of the well; and an extended position in which the drilling member contacts an inner surface of the well;

wherein the inner face of the anchoring member is in fluid communication via said hydraulic fluid with the inner face of the drilling member such that both respective inner faces experience the same pressure of the said hydraulic fluid acting upon them;

wherein the drilling tool further comprises a movement mechanism for rotating the drilling member about its longitudinal axis;

wherein the movement mechanism comprises a rotational translation movement mechanism arranged to translate rotational movement of a shaft rotatable in use about a longitudinal axis coincident and/or parallel with said longitudinal axis of the drilling tool into rotational movement of the drilling member about its longitudinal axis;

wherein the drilling tool is further adapted to also connect to a downhole torque generator which comprises a rotatable shaft and wherein at least a portion of the said movement mechanism of the drilling tool is coupled to the rotatable shaft which provides said rotational movement;

wherein the drilling tool is coupled to a motive assembly having said rotatable shaft, wherein operation of the motive assembly is configured to rotate the rotatable shaft and rotate said at least a portion of the movement mechanism of the drilling tool;

wherein the motive assembly comprises a battery pack and a motor; and wherein the tool further comprises a rotary assembly operatively coupled to the motive assembly, wherein the rotary assembly comprises a piston, and wherein the motor is capable of being operated in reverse rotation which reverses rotation of the rotatable shaft and reduces fluid pressure within the tool due to retraction of the piston.

30. A method for drilling through a sidewall in a tubular in a well, the method comprising:

deploying a drilling tool into the well to the depth at which the sidewall of the tubular is to be drilled, wherein the drilling tool comprises:

one or more anchoring members and a drilling member and a drive shaft rotatably connected to the drilling member;

the method further comprising:

rotating the drive shaft and thereby rotating the drilling member around an axis perpendicular to a longitudinal axis of the drilling tool; and applying fluid pressure to an inner face of the one or more anchoring members to firstly move the one or more anchoring members radially into contact with an inner surface of the well in response to modification of the fluid pressure;

applying fluid pressure to an inner face of the drilling member to secondly move the drilling member radially in response to modification of the fluid pressure;

reducing fluid pressure to the inner face of the drilling member to firstly move said drilling member into a retracted position in which the drilling member is spaced apart from an inner surface of the well;

reducing fluid pressure to the inner face of one or more anchoring members to secondly move said one or more anchoring members into a retracted position in which the at least one anchoring member is spaced apart from an inner surface of the well; and reversing the direction of rotation of the drive shaft to reduce fluid pressure within the tool to firstly move said drilling member and secondly move said one or more anchoring members into said respective retracted positions.

* * * * *